US006082734A

United States Patent [19]

Uehara et al.

[11] Patent Number: 6,082,734

[45] Date of Patent: Jul. 4, 2000

[54] BALL GAME MACHINE

[75] Inventors: Isao Uehara, Yamagata; Takahiro Sakiyama, Zama, both of Japan

[73] Assignee: Konami Co., Ltd., Hyogo-ken, Japan

[21] Appl. No.: 09/186,523

[22] Filed: Nov. 5, 1998

[30] Foreign Application Priority Data

Nov. 10, 1997 [JP] Japan ..... 9-325339

[51] Int. Cl.[7] ..... A63F 3/06; A63F 9/24

[52] U.S. Cl. ..... 273/142 E; 273/138.2; 273/138.3; 273/138.4; 273/142 R

[58] Field of Search ..... 273/138.1, 142 R, 273/142 A, 142 B, 142 C, 142 D, 142 E, 142 F, 142 G, 142 J, 142 JA, 142 JB, 142 JC, 142 JD, 143 R, 143 C, 143 D, 143 E, 118 R, 118 A, 119 R, 119 A, 138.2, 138.3, 138.4

[56] References Cited

U.S. PATENT DOCUMENTS

| | | | |
|---|---|---|---|
| 5,360,214 | 11/1994 | Harmen | 273/142 E X |
| 5,634,639 | 6/1997 | Tokito et al. | 273/138.1 X |
| 5,639,089 | 6/1997 | Matsumoto et al. | 273/142 E |

FOREIGN PATENT DOCUMENTS

| | | |
|---|---|---|
| 8084803A | 4/1996 | Japan . |
| 8084804A | 4/1996 | Japan . |

*Primary Examiner*—Raleigh W. Chiu
*Attorney, Agent, or Firm*—Jordan and Hamburg LLP

[57] ABSTRACT

To provide a ball game machine that may simplify the structure by improving the position of balls, the ball game machine includes: a wheel device which has a plurality of ball holding portions along an inner circumference thereof and which is rotatably provided along a predetermined swivel path having a difference in height; a receiving device disposed on a side of an upper end of the swivel path of said wheel device for receiving a predetermined number of balls; a throwing device for throwing the balls received in said receiving device downwardly from the side of the upper end of the swivel path; a guide device for leading the balls thrown by said throwing device to the ball holding portions of said wheel device fed on the side of the lower end of the swivel path; and a collection device disposed on the side of the upper end of the swivel path of said wheel device for collecting the balls, which are held in the ball holding portions, to said receiving device.

18 Claims, 23 Drawing Sheets

135
133B
130
131
137
131a
133A
132

125
126
128
129
126
125

120
121
130
131
134
135
133B
138
136
125
129
125

BALL GAME MACHINE

BACKGROUND OF THE INVENTION

The present invention relates to a ball game machine for executing a drawing process using a ball in order to enjoy a bingo game or the like.

For such a kind of game machines, Japanese Patent Nos. 2579738 and 2579739 disclose a game machine in which a ring-like wheel in which a number of pockets serving as ball holding portions are provided in a circumferential direction thereof is rotated along a vertical plane, the balls are dropped one by one from an upper end side to a lower end side of the inner circumferential portion of the wheel, and each ball is introduced into one of the pockets fed to the lower end side of the wheel at a time each ball has reached the lower end so that the number assigned to the pocket is drawn as a lucky number.

When a one turn game has been completed in the game machine, the balls taken in the wheel are collected in a collecting portion located below the wheel. Then, when the next game is started, the balls are hit upwardly one by one to the upper end side of the wheel along an outer circumference of the wheel by a throwing mechanism disposed adjacent to the collecting portion.

In the above-described game machine, it is necessary to hit the ball upwardly from the lower end side to the upper end side of the wheel, and to generate a hitting force corresponding to weight of the ball by providing a spring or the like in the throwing mechanism.

SUMMARY OF THE INVENTION

It is an object of the present invention to provide a ball game machine which may simplify a structure by improving a collection position of balls.

In order to solve the above-described and other problems, there is provide a ball game machine comprising:

- a wheel device which has a plurality of ball holding portions along an inner circumference thereof and which is rotatably provided along a predetermined swivel path having a difference in height;
- a receiving device disposed on a side of an upper end of the swivel path of said wheel device for receiving a predetermined number of balls;
- a throwing device for throwing the balls received in said receiving device downwardly from the side of the upper end of the swivel path;
- a guide device for leading the balls thrown by said throwing device to the ball holding portions of said wheel device fed on the side of the lower end of the swivel path; and
- a collection device disposed on the side of the upper end of the swivel path of said wheel device for collecting the balls, which are held in the ball holding portions, to said receiving device According to the present invention, if one game has been completed, the balls are collected from the ball holding portions at the upper end side of the swivel path of the wheel device and held in the receiving device. In the next game, the balls received in the receiving device are thrown toward the lower end side of the swivel path of the wheel device. Thus, the collection and maintenance of the balls are attained in the upper end side of the swivel path so that it is unnecessary to hit the balls upwardly by the throwing device. Accordingly, the throwing device can be simplified.

The receiving device may include a rotary member provided with a plurality of projections at a predetermined pitch along a circumferential direction on an outer circumference thereof so that the balls can be received between the adjacent projections.

According to this case, it is possible to rotate the rotary member and receive the plurality of balls on the outer circumference thereof on after another. The receiving device may comprise a box in which the rotary member is housed.

The projections may be formed into vane-shapes slanted obliquely to an axial direction of said rotary member.

According to this case, it is possible to feed the balls to the ball guide device by using the slant of the projections of the rotary member. Therefore, the rotary member is functioned as a throwing device to simplify the mechanism to reduce the number of the mechanical parts.

The number of the plurality of projections may be greater by one than the number of the balls to be used in a game, and an inlet and an outlet for the balls may be formed to be displaced in a rotational direction of said rotary member by a level corresponding to the pitch of said plurality of projections in said receiving device.

According to this case, when the rotary member is rotated, the receiving spaces defined between the adjacent projections are fed in order just before the inlet and the outlet. Accordingly, the rotary member is rotated by one pitch of the projections so that the balls to be introduced through the inlet may be received in the respective spaces one by one and the balls received in the respective spaces may be fed out in order from the outlet. Since the number of the receiving spaces is greater than the number of the used balls, there is no possibility that the balls would be fed to the portion before the outlet when the balls are received and the balls would be fed before the inlet so that the balls would be guided in an undesired direction when the balls are thrown.

The receiving device may comprise a box in which the rotary member is housed and the inlet and the outlet for the balls may be formed on the box. Each of the projections may be slanted downward with approaching the outlet for the balls when in a position opposite to said outlet to thereby allow the receiving device to serve as the throwing device.

Each of the ball holding portions may be provided with a pair of opening-and-closing members capable of being switched between an opening condition where an inlet-and-outlet opening of each of the ball holding portions is largely opened beyond a diameter of the balls and a restricted condition where the inlet-and-outlet port is more narrowly closed than the diameter of the balls and an operating member driving at least one of the opening-and-closing members for switching the inlet-and-outlet opening from the restricting condition to the opening condition, and said collection device may be provided with a release member which is movable between an operating position entering a movement path of said operating member in accordance with a swivel motion of said wheel device and a waiting position which is below the operating position and where the release member is retracted out of the movement path.

According to this case, when the wheel device is swiveled under the condition that the release member is raised up to the operating position, the operating member of each ball holding portion is brought into contact with the release member, the respective opening-and-closing members are switched over to the opening condition. Thus, the restriction by the opening-and-closing members for the balls received in the ball holding portion is released. The balls drop from the ball holding portions to be introduced into the receiving device. In the case where the release member is retracted to the waiting position, the operating member is out of contact with the release member so that the wheel device may be swiveled while the balls are restricted within the ball holding portion.

The ball holding portion may be provided with a pair of side walls which are opposite to each other in a rotational direction of the wheel device to define a receiving space of one of the balls, one of the side walls may be provided with a movable member pivotally connected thereto through a hinge so as to be pivotable about a pivot shaft parallel to a rotational axis of the wheel device, said opening-and-closing members may be attached to inner end portions of both of another one of the side walls and the movable member respectively, the movable member may be biased by a biasing device to locate the opening-and-closing members in the restricted condition, and the operating member may be attached to the movable plate with projecting an inner end thereof from the inner end portions of the side walls so as to be capable of being engaged with the release member in the operating position to thereby operate the movable member against the biasing device to switch the pair of the opening-and-closing members to the opening condition.

The ball game machine may further comprise a buffering device for imparting resistance to a returning operation of said at least one of the opening-and-closing members when moving from the opening condition to the restricting condition.

According to this case, even if the opening-and-closing member and the release member are separated away from each other in the midway when the opening-and-closing member is opened to the opening condition so that the ball is dropped away from the ball holding portion, the opening-and-closing member is subjected to the resistance of the buffering device so that the opening-and-closing member is restored slowly back to the restrictive condition.

The wheel device may be provided so as to be rotatable in the swivel path parallel extending in a vertical plane. In this case, it is possible to collect and throw the balls relative to the wheel device by using a gravitational force applied to the balls. It is possible to dispense with other power for driving the components for this operation. Thus, this makes it possible to simplify the mechanism. The collection device, the receiving device and the throwing device may be substantially disposed at the top end of the swivel path. The receiving device may be disposed below the top end portion of the swivel path.

A single portion may be used commonly for the inlet-and-outlet opening of the ball holding portion. In this case, it is possible to collect the balls by dropping the balls from the ball holding portion to the inner circumferential side of the wheel device on the upper end side of the wheel device. Also, it is possible to receive the balls from the inner circumferential side of the wheel device to the ball holding portion, when the balls have been introduced to the lower end side of the wheel device through the ball guide device. Thus, since the feeding-out direction of the balls from the ball holding portions and the receiving direction of the balls relative to the ball holding portions are common with each other, it is sufficient to provide the opening portion which serves as an inlet port and an outlet port for the balls, so as to face the inner circumferential side of the wheel device. It is unnecessary to consider the loading/unloading of the balls on the outer circumferential side of the wheel device. Thus, it is possible to simplify the structure of the ball holding portions.

The guide device may be provided with an irregular motion generating device for irregularly moving the balls in a direction intersecting a vertical direction to thereby change a time period during which each of the balls reaches a lower end of the swivel path after being thrown by the throwing device.

The irregular motion generating device may be provided with a swivel shaft capable of swiveling about an axis thereof slanting relative to the vertical direction and a plurality of stages attached to the swivel shaft so as to be rotatable therewith, each of the stages may be provided with a drop obstacle portion to receive the balls with allowing movement in a direction perpendicular to the axis of the swivel shaft and an opening allowing the passage of each ball, and the respective stages may be attached to the swivel shaft in such a manner that the opening formed on an upper stage within a pair of the stages which are vertically adjacent each other overlaps in the vertical direction with the drop obstacle portion provided on a lower stage within said pair of the stages and each opening formed on each of said pair of the stages is deviated from each other in a circumferential direction of the stages.

The ball game machine may further comprise a support member for supporting upper and lower ends of the swivel shaft so as to be rotatable about the axis thereof and a driving device for rotating the support member about a vertical axis. The wheel device may be rotated around the guide device.

DETAILED DESCRIPTION OF THE PREFERRED EMBODIMENTS

Figure 1:
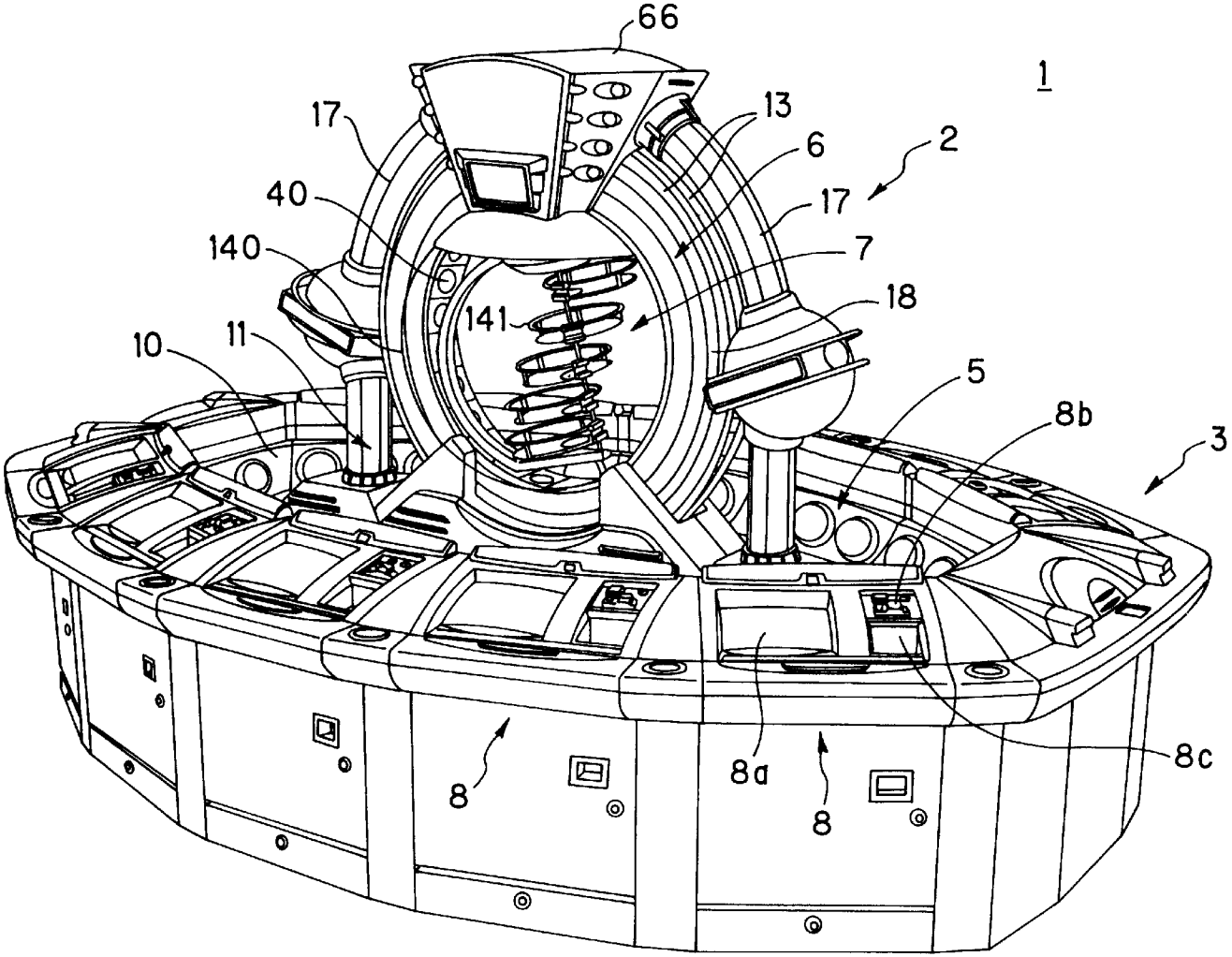
FIG. 1 is a perspective view showing one embodiment of a ball game machine to which the present invention is applied.
Figure 2:
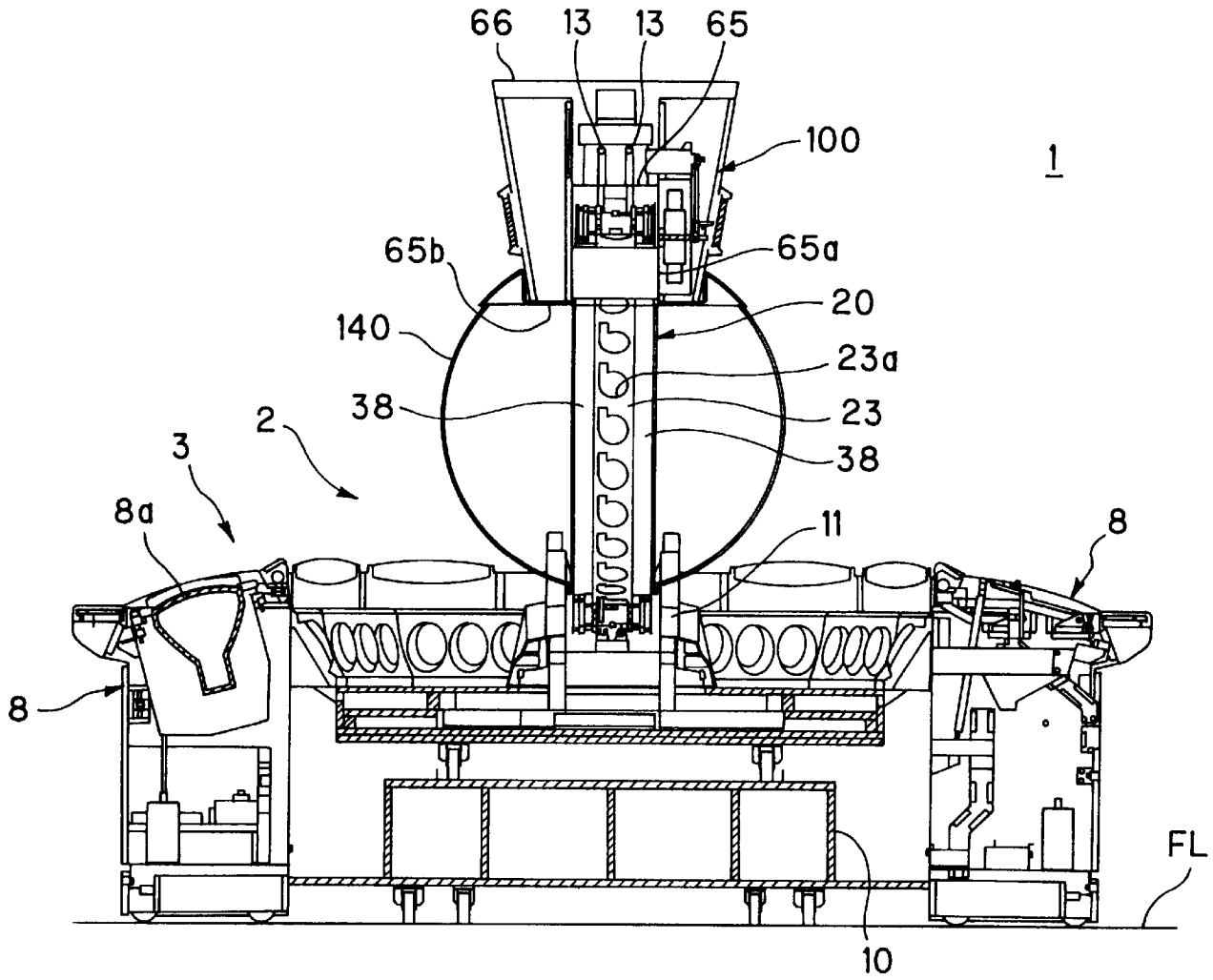
FIG. 2 is a vertical cross-sectional view showing the ball game machine shown in FIG. 1.

FIGS. 1 and 2 show an overall structure of a ball game machine to which the present invention is applied. As shown in these figures, the ball game machine 1 has a game executing section 2 and a game operating section 3. The game executing section 2 is for executing a drawing process by using balls and is provided with a body section 5, a wheel section 6 supported by the body section 5 and a ball guide section 7 disposed in an inner circumference of the wheel section 6. Six balls per one game are thrown one by one from an upper end of the ball guide section 7, while the wheel section 6 is drivingly rotated along a vertical plane when the game is executed. Then, each ball which has reached the lower end of the ball guide section 7 is taken into a pocket 40 (see FIGS. 4 and 6) of the wheel section 6, and a lucky number or the like is determined. The detail will be described later.

On the other hand, the game operating section 3 is for the player to perform the bingo game or the like in response to the drawing result by the game executing section 2, and is provided with a plurality of terminal machines 8 arranged so as to surround a periphery of the body section 5. Each terminal machine 8 is provided with a display device 8*a* for displaying a game image, operating instructions or the like, a control panel 8*b* provided with buttons or the like for betting and a medal insert slot, a medal pay-out outlet 8*c* for paying out the medals or the like obtained by the player, and a controller (not shown) for controlling the progress of the game performed through the display device 8*a*. The basic structure of the terminal machine 8 is well known in the art.

Figure 3:
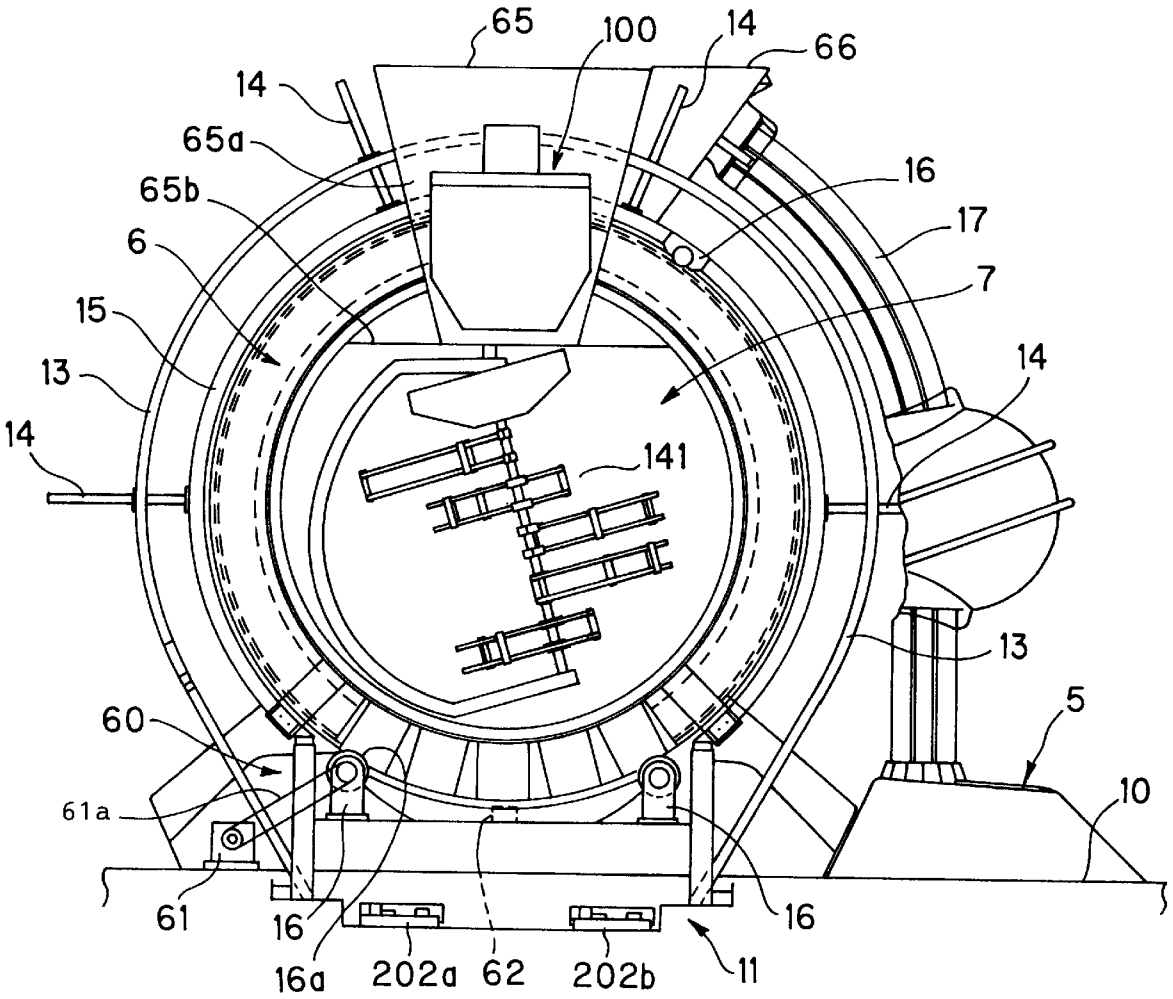
FIG. 3 is a schematic view showing a structure of a wheel section of the ball game machine shown in FIG. 1 and its periphery.

The body section 5 of the game executing section 2 is mainly composed of a housing 10 disposed horizontally on a floor surface FL. A wheel support portion 11 is provided at a central portion of a top surface of the housing 10. The game executing section 2 above the wheel support portion 11 is schematically shown in FIG. 3.

A pair of rod-like frames 13, 13 extending so as to form arcs along a vertical plane are mounted on the wheel support portion 11 (see FIGS. 1 and 2). A wheel support loop 15 is mounted through stays 14 . . . 14 on an inner circumference of these frames 13, 13. A plurality of roller guides 16 . . . 16 (part of which is shown in FIG. 3) are mounted on the wheel support loop 15 at suitable intervals in the circumferential direction. The wheel section 6 is mounted on the inside of these roller guides 16. Incidentally, as is apparent from FIG. 1, a decorating portion 17 having fluorescent tubes, neon tubes or the like is provided on the outer circumference of the frames 13. Part of the decorating portion 17 is shown in FIG. 3.

Figure 4:
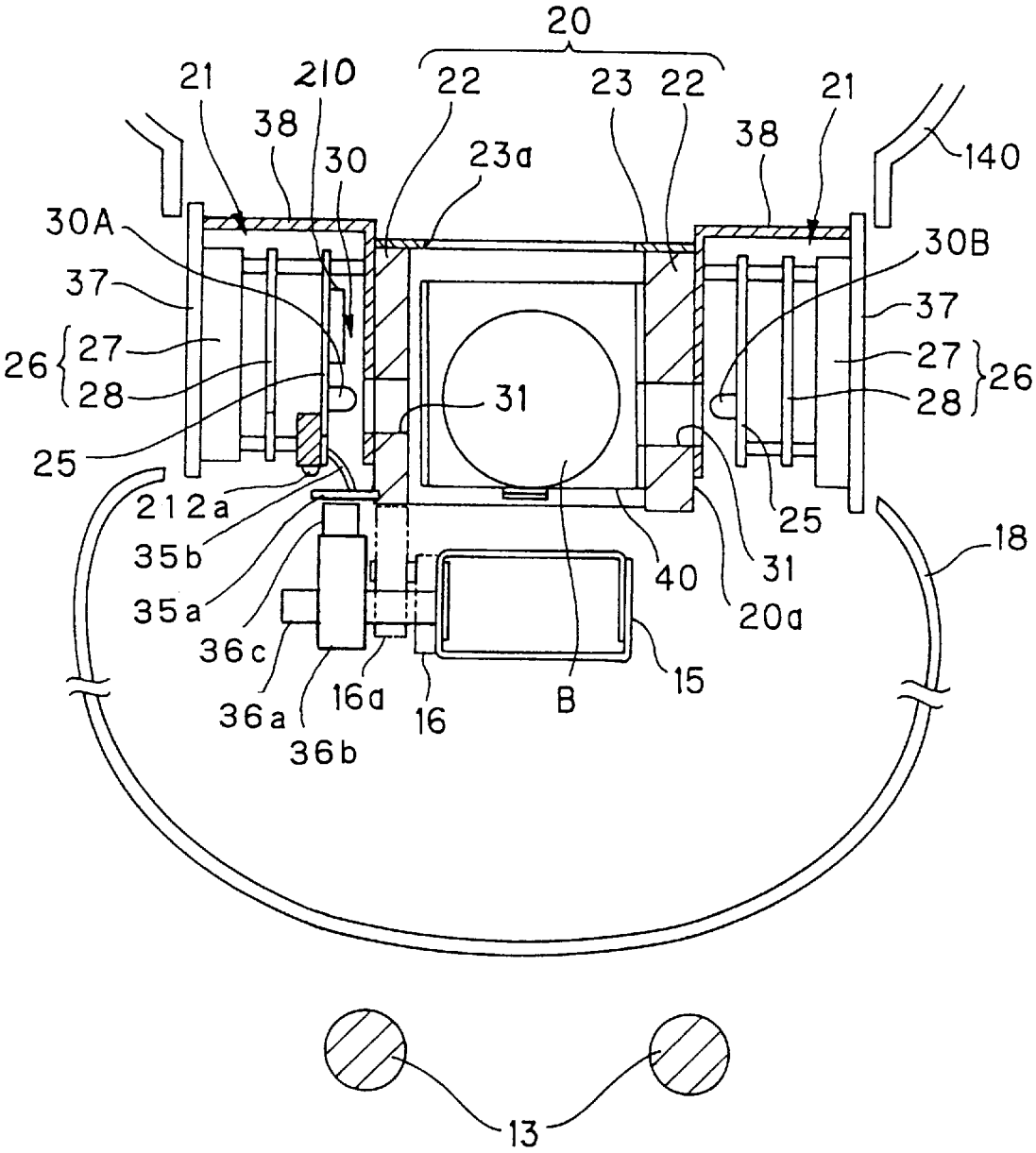
FIG. 4 is a transversal sectional-view of the wheel section.

As is apparent from FIG. 4 showing a cross-section of the wheel section 6, the latter is provided with a ring-like wheel body 20, and control units 21, 21 mounted on both side surfaces 20*a*, 20*a* of the wheel body 20. The wheel body 20 has a pair of annular frame plates 22, 22 connected in parallel with each other through joint members (not shown) and an end plate 23 mounted on the inner circumferential side of these frame plates 22. The outer circumferential portions of the frame plates 22 are in contact with rollers 16*a* of the roller guides 16 so that the wheel body 20 is rotatably supported in the vertical plane.

The end plate 23 is provided with twenty-five ball passage holes 23*a* . . . 23*a* formed at an equal interval in the circumferential direction thereof (see FIG. 2). Between the frame plates 22, 22, there are provided twenty-five pockets 40 serving as ball holding portions in alignment with the ball passage holes 23*a* in the circumferential direction. The details of the pockets 40 will be described later.

Figure 5:
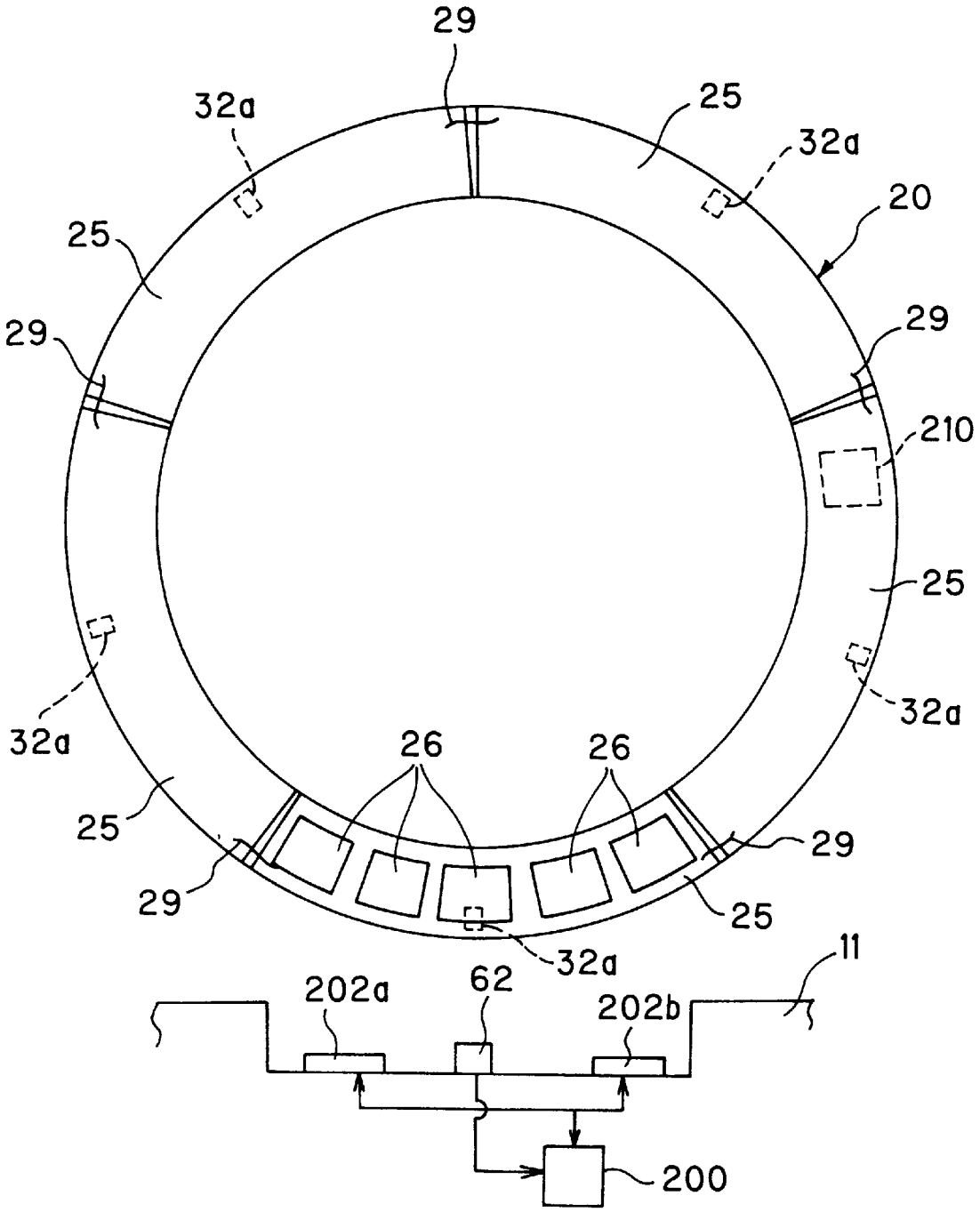
FIG. 5 is a view showing an arrangement of control system parts in the wheel section.

The control units 21 are provided with control substrates 25 mounted on both side surfaces 20*a* of the wheel body 20 and display units 26 mounted on the control substrates 25. As shown in FIG. 5, five blocks of the control substrates 25 are provided on one side surface of the wheel body 20 and therefore ten blocks of the control substrates 25 are provided on both side surfaces thereof. Then, a wheel side CPU 210 for controlling a variety of electronic parts mounted on the wheel section 6 is mounted on one block of the control substrates 25. The control substrates 25 of the other nine blocks are connected through communication cables 29 to the control substrate 25 on which the CPU 210 is mounted.

Five display units 26 are mounted on each control substrate 25. Namely, twenty-five display units 26 whose number is the same as that of the pockets 40 are mounted on one side surface of the wheel body 20, and therefore fifty display units 26 are mounted on both side surfaces thereof in total. Then, each display units 26 is mounted in alignment with the associated pocket 40 in the circumferential direction.

Figure 6:
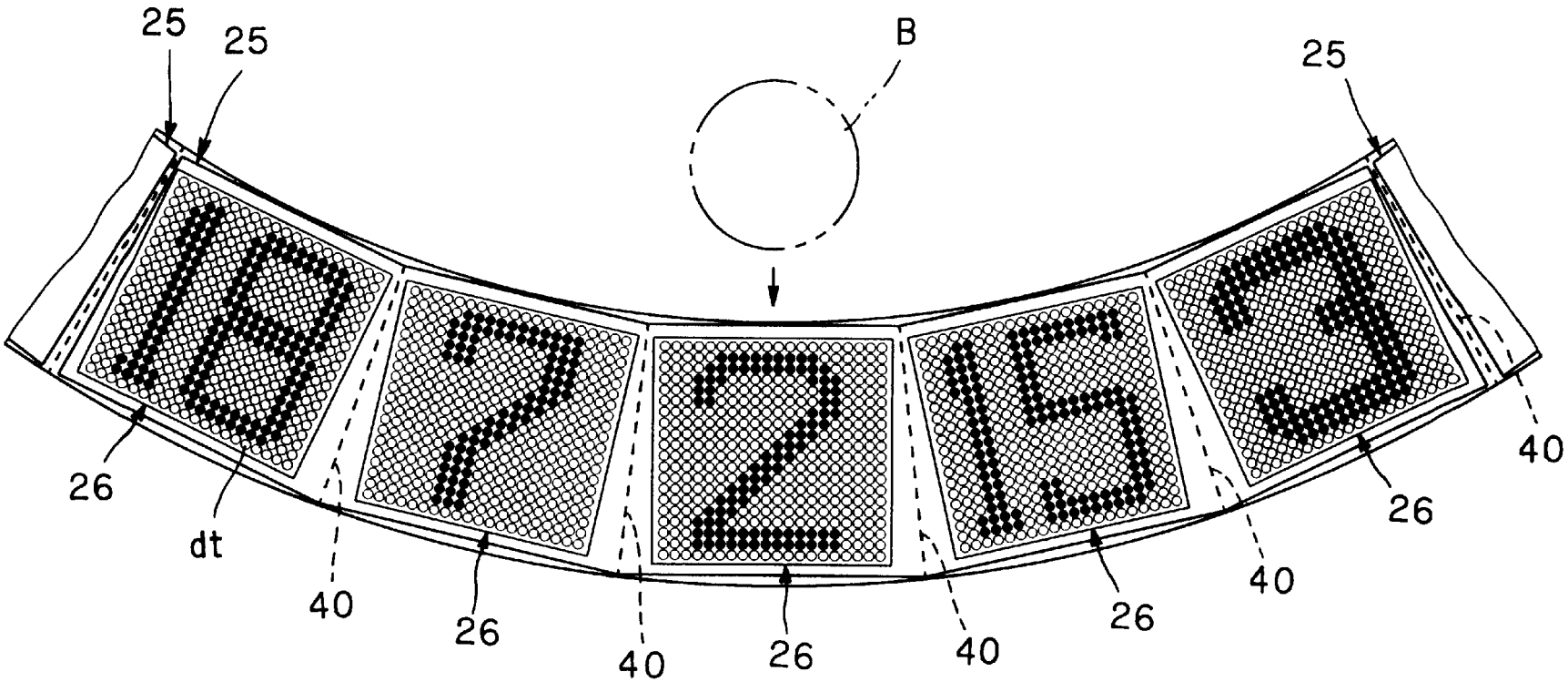
FIG. 6 is an enlarged view showing a display unit provided on one side of the wheel section.
Figure 7:
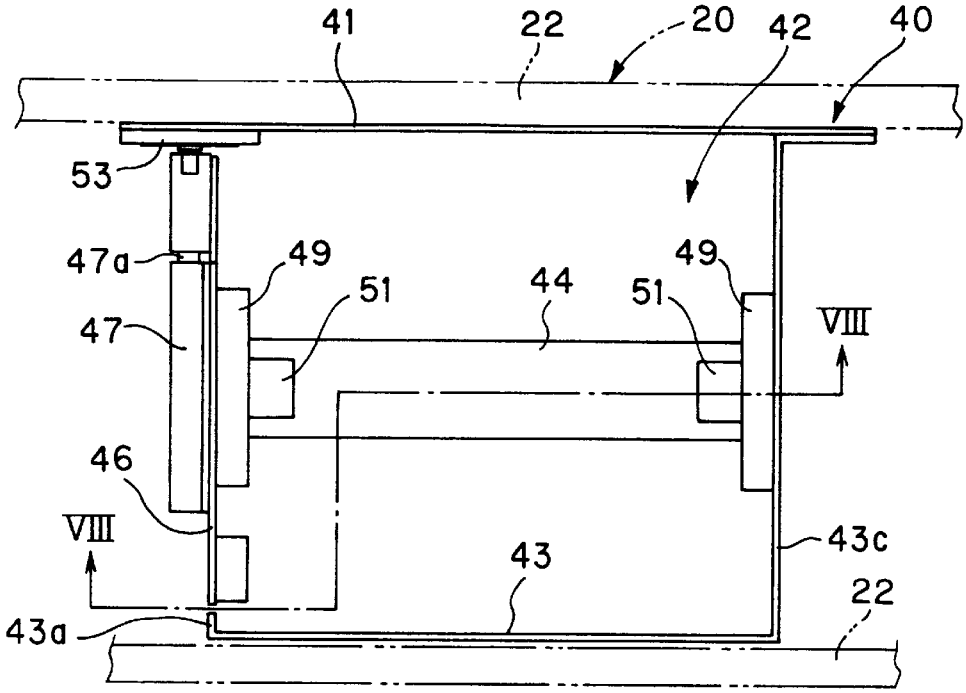
FIG. 7 is a plan view showing a pocket serving as a ball holding portion provided in the wheel section.

As shown in FIG. 4, each display unit 26 has a display panel 27 for displaying a drawn number or the like assigned to each pocket 40 and a panel control substrate 28 on which a drive circuit is mounted for controlling the display of the display panel 27 in accordance with a command issued from the wheel side CPU 210. As best shown in FIG. 6, for example, a dot matrix system in which a plurality of LEDs (light emitting diodes) which are different in emitting colors are combined with each other to form a single dot dt and the dots dt are arranged in a matrix in the lateral direction and the vertical direction is used for the display panel 27. Incidentally, FIG. 6 shows a state in which any one of integers of 1 to 25 is displayed at random on the display panel 27. The display system is not limited to this and it is possible to perform a variety of displays by controlling the turn-on and-off of each dot dt. For instance, by changing combination of the turn-on and-off of the plurality of LEDs forming the dot dt, it is possible to display a plurality of kinds of colors per single dot unit.

As shown in FIG. 4, a pocket sensor 30 for detecting the absence/presence of the ball B in each pocket 40 is mounted in the control unit 21 in a one-to-one relation to each pocket 40. The pocket sensor 30 has a light emitting portion 30A mounted on the control substrate 25 on one side of the wheel body 20 and a light receiving portion 30B mounted on the control substrate 25 on the opposite side. During the execution of the game, a predetermined detection light beam is emitted to the light receiving portion 30B through a throughhole 31 formed through the wheel body 20 and the pocket 40. When the ball B is received in the pocket 40, the detection light beam is interrupted to change an output signal from the light receiving portion 30B. The CPU 210 judges the presence/absence of the ball B within each pocket 40 in accordance with this output signal.

As shown in FIGS. 4 and 5, five (in total) signal transmitting/receiving head 212*a* of an infrared ray communication unit 212 (see FIG. 25) for performing the communication with a body side CPU 200 provided on the body section 5 are mounted on the control substrates 25 disposed on one side surface of the wheel body 20 with one head for one substrate 25.

As shown in FIG. 4, an electrode ring 35*a* is provided on one side of the wheel body 20. A brush holder 36*b* is mounted through a support member 36*a* on the wheel support loop 15. A brush 36*c* in sliding contact with the electrode ring 35 is mounted at a tip end of the brush holder 36*b*. In accordance with the rotation of the wheel section 6, the electrode ring 35*a* is rotated in contact with the brush 36*c* so that an electric power of the electric power source is supplied from the body section 5 to the control substrates 25 of the wheel section 6 through the electrode ring 35*a* and a cable 35*b*.

As shown in FIGS. 1 and 4, a wheel cover 18 is provided on the body section 5 for hiding the structure of the wheel section 6 on the outer circumferential side from the player. Translucent covers 37, 37 are mounted on both sides of the wheel section 6. By these covers 37, only the display contents of the display unit 26*s* on the side surface of the wheel section 6 are visible and the details of the display units 26 and the control substrates 25 are hidden when the game machine 1 is observed from the outside thereof. Furthermore, covers 38, 38 are mounted between the wheel body 20 and the control substrates 25 for covering the inner circumferential sides of the control units 21.

FIGS. 7 to 10 show the pocket 40 in detail. The pocket 40 has a pocket base plate 41 fixed by fastening means such as bolts (not shown) to the inner surface of one of the frame plates 22 of the wheel body 20, a frame plate 43 for defining a receiving space 42 of the ball B in cooperation with the pocket base plate 41, and a bottom plate 44 fixed to the frame plate 43 for preventing the ball B from dropping toward the outer circumferential side (downwardly of FIG. 8) of the pocket 40. A cutaway portion 43*b* is formed on one side wall 43*a* of the frame plate 43 and a movable plate 46 is disposed in the cutaway portion 43*b*. The movable plate 46 is pivotally connected to the side wall 43*a* through a hinge 47. A torsion coil spring 48 is mounted on a pivot shaft 47*a* of the hinge 47. The movable plate 46 is biased in the clockwise direction in FIG. 8 about the pivot shaft 47*a* by spring force of the spring 48 and is abutted to a stop (not shown) to be kept substantially flush with the side wall 43*a*.

Holders 49, 49 are mounted on both of the movable plate 46 and the side wall 43*c* of the frame plate 43 confronting with the movable plate 46. Claws 51, 51 serving as members for opening and closing an inlet-and-outlet opening for the pocket 40 are rotatably mounted about pins 50. Each claw 51 is abutted against a retainer surface 49*a* of the holder by a biasing means (not shown) such as a spring or the like to be held in a posture substantially perpendicular to each side wall 43*a*, 43*c* (in a position indicated by solid lines in FIG. 8). When the ball B is dropped from the pocket 40 toward the receiving space 42, each claw 51 is depressed into the interior of the receiving space 42 against the biasing means as indicated by an imaginary line L1 in FIG. 8 so that the ball B is received in the receiving space 42.

Figure 8:
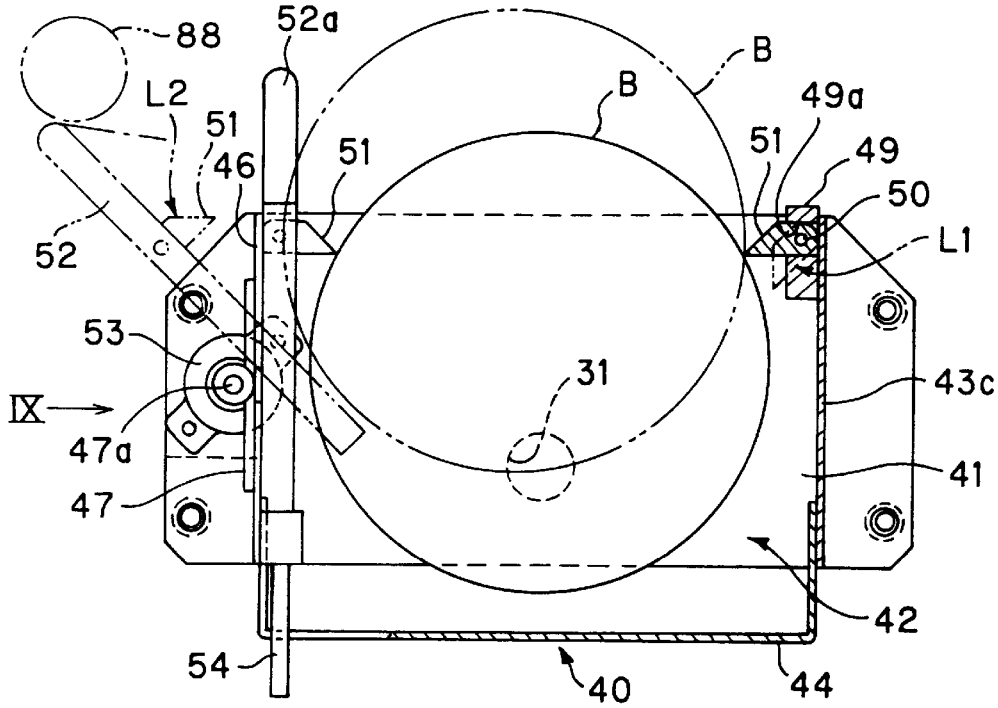
FIG. 8 is a cross-sectional view taken along the line VIII—VIII of FIG. 7.
Figure 9:
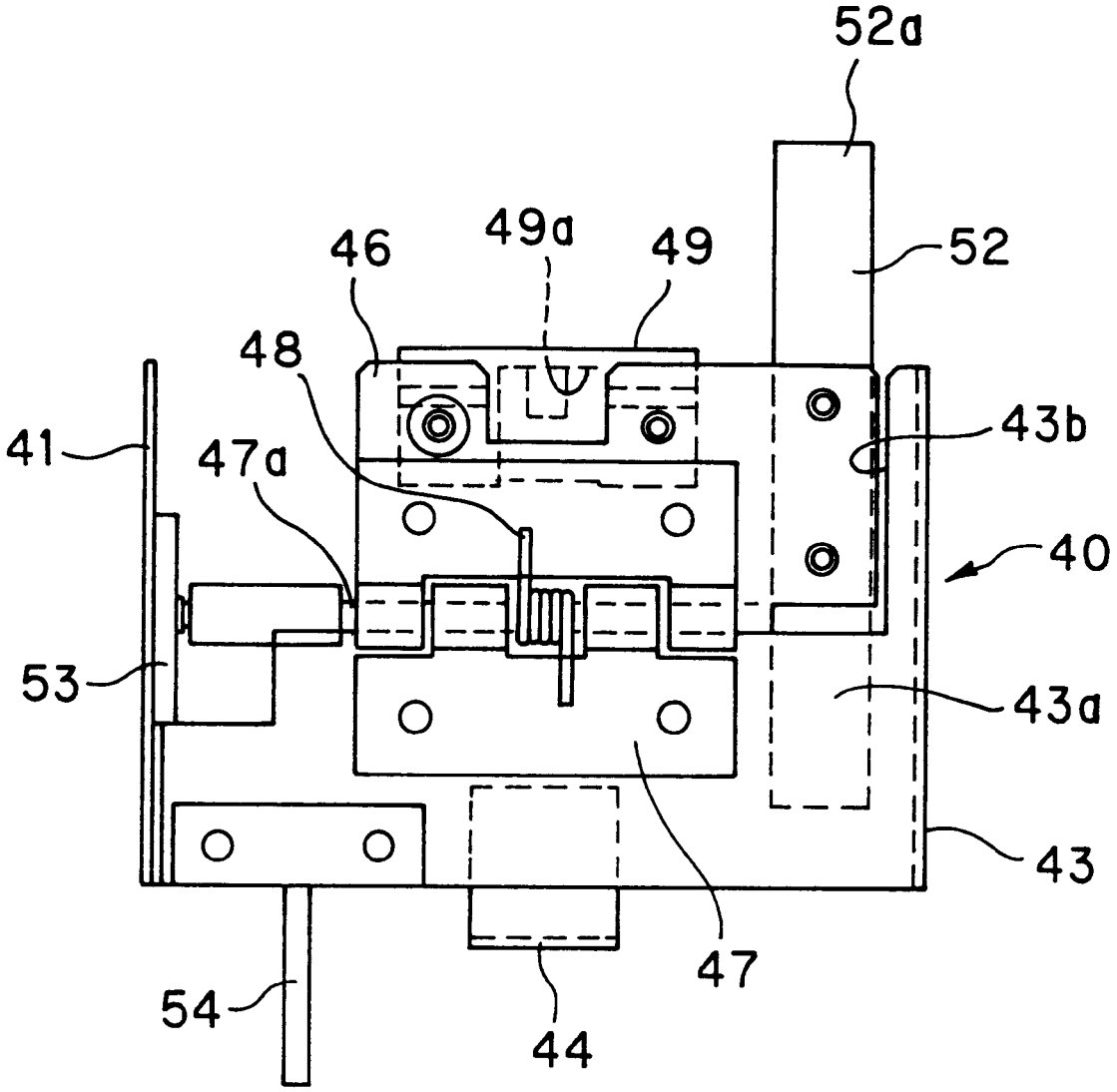
FIG. 9 is a side elevational view showing the pocket as viewed in a direction IX of FIG. 8.
Figure 10:
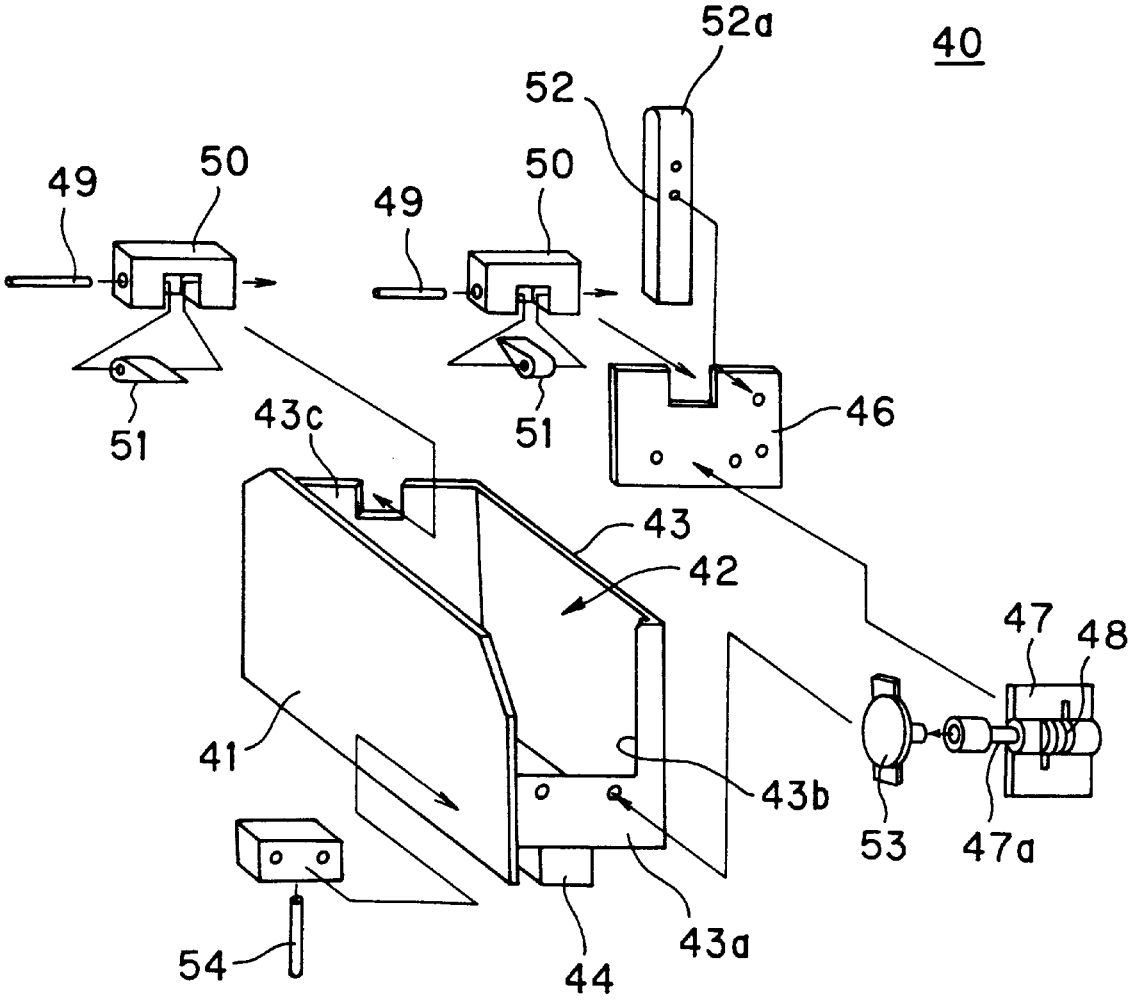
FIG. 10 is an exploded perspective view showing the pocket.
Figure 11:
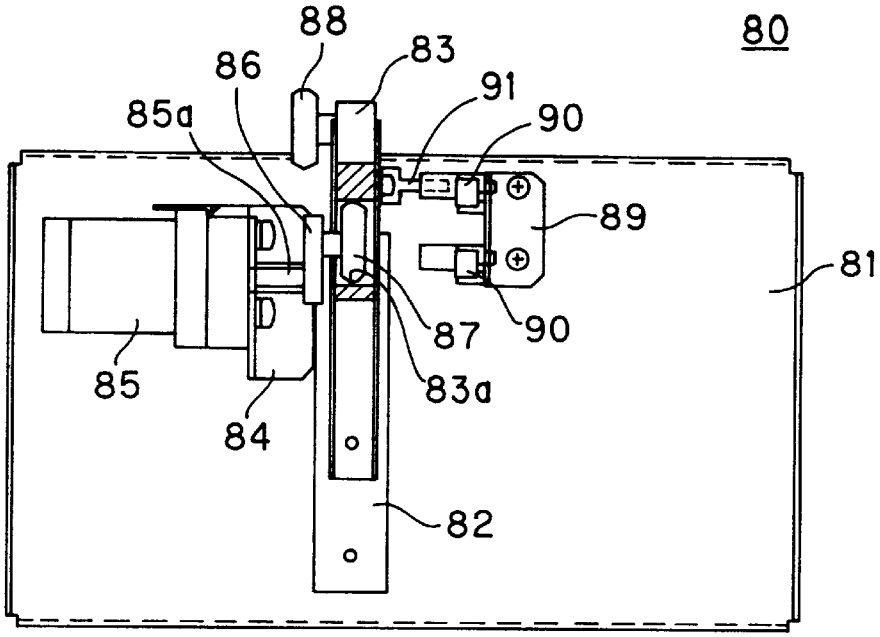
FIG. 11 is a side elevational view showing a release unit serving as a collection device.

When the ball B is received in the receiving space 42, the claws 51 are returned back to the postures indicated by the solid lines in FIG. 8 by the force of the biasing means so that a distance between the claws 51 is smaller than a diameter of the ball B. For this reason, even if the pocket 40 is reversed upside down, the ball B is no longer dropped from the receiving space 42 but may be held within the pocket 40.

A drive lever 52 serving as an operating member for operating the claw 51 is fixed to the movable plate 46. A distal end portion 52*a* of the drive lever 52 is projected into the inner circumferential side of the wheel body 20 beyond the end plate 23 (see FIG. 4) of the wheel body 20. As shown by an imaginary line L2 in FIG. 8, when the distal end 52*a* of the drive lever 52 is depressed in a direction away from the pocket 40, the movable plate 46 is opened against the spring force of the spring 48 of the hinge 47 so that one of the claws 51 is retracted backward. Thus, the ball B may be picked up from the receiving space 42.

The pivot shaft 47*a* of the hinge 47 is coupled with a damper 53 fixed to the pocket base plate 41. The damper 53 serves as a buffering device for imparting a constant resistance to the returning operation of the hinge 47 by the spring force of the spring 48. By the buffering action of the damper 53, the returning operation of the claw 51, i.e., the returning operation from the state indicated by the imaginary line L2 in FIG. 8 to the position indicated by the solid line is moderated. As a result, there is no possibility that, when the ball B is to be picked up, the claw 51 would be quickly returned so that the ball B might be clamped between the claws 51. Incidentally, a detection rod 54 is mounted on the frame plate 43 for detecting the pocket 40 from the outer circumferential side of the wheel body 20.

As shown in FIG. 3, a wheel drive mechanism 60 is provided in the wheel support portion 11 of the body section 5 for driving and rotating the wheel section 6. The wheel drive mechanism 60 transmits the rotation of the output shaft of a wheel drive motor 61 to the roller 16*a* of the roller guide 16 through a belt 61*a* to thereby rotate and drive the wheel section 6 in the vertical plane. The rotation of the wheel section 6 is judged by detecting the passage of the detection rod 54 of the pocket 40 by a wheel rotation sensor 62. A pair of signal transmitting/receiving heads 202*a* and 202*b* (see FIG. 5) are provided on both sides of the sensor 62 for performing infrared communication with the signal transmitting/receiving head 212*a* of the wheel section 6.

As shown in FIGS. 2 and 3, a unit mounting base plate 65 is fixed to upper ends of the frames 13. On the unit mounting base plate 65, there are provided a release unit 80 (FIGS. 11 to 14) for collecting the balls B from the pockets 40 of the wheel section 6, a supplier unit 100 (FIGS. 15 to 17) for accommodating and throwing the balls B, and an object drive unit 120 (FIGS. 18 to 21) for driving an object of the ball guide section 7. Incidentally, the unit mounting base plate 65 and the respective units 80, 100 and 120 are covered by a top cover 66 (see FIG. 1).

As shown in FIGS. 11 to 14, the release unit 80 has a base plate 81 fixed to the mounting base plate 65, a slider 83 mounted on the base plate 81 through a linear guide unit 82 so as to be movable in the vertical direction, and a release motor 85 mounted on the base plate 81 through a bracket 84. A roller 87 is rotatably mounted on an output shaft 85*a* of the motor 85 through a roller holder 86. The roller 87 is fitted in an angular hole 83*a* of the slider 83. When the output shaft 85*a* of the motor 85 is rotated, the roller 87 is rotated about the output shaft 85*a* while being fitted in the angular hole 83*a* so that the slider 83 is reciprocating moved up and down.

Figure 12A:
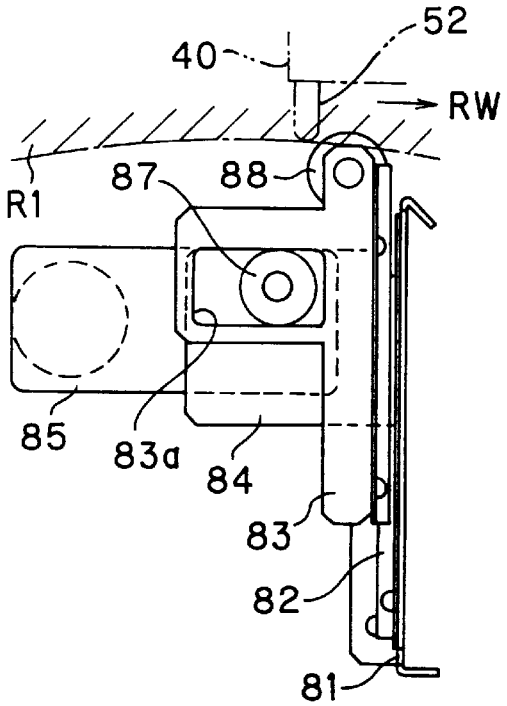
FIGS. 12A and 12B are views showing the operation of the release unit.
Figure 12B:
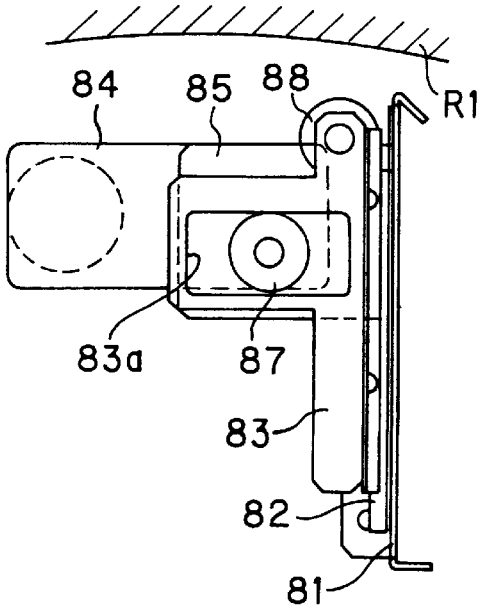
Figure 13:
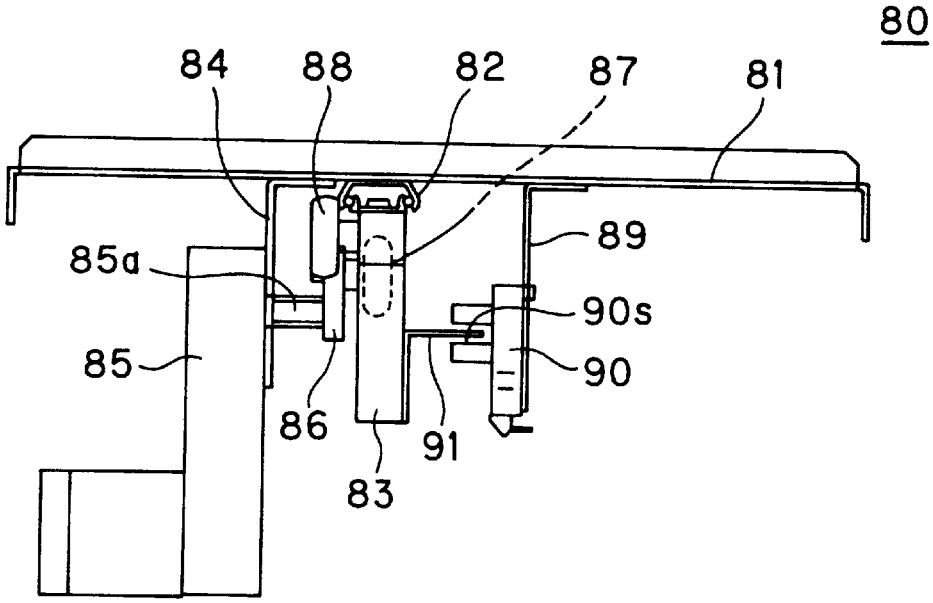
FIG. 13 is a plan view showing the release unit.
Figure 14:
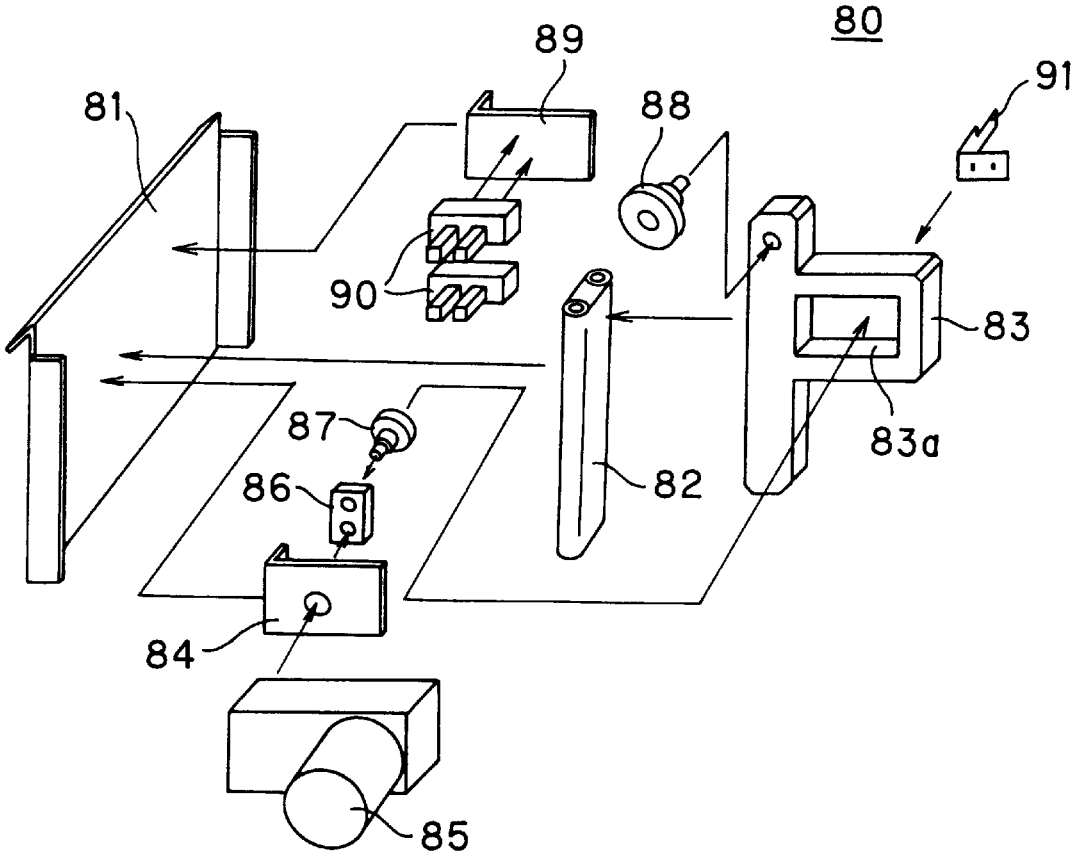
FIG. 14 is an exploded perspective view showing the release unit.

A release roller 88 is rotatably mounted at a top end of the slider 83. The drive lever 52 (see FIG. 8) is driven by the release roller 88 so that the ball B is picked up from the pocket 40. Namely, as shown in FIG. 12A, the release roller 88 is mounted so as to face a movement path R1 (a region hatched in FIGS. 12A and 12B) of the drive lever 52 at the upper end portion of the wheel section 6. Then, under the condition that the slider 83 is raised as shown in FIG. 12A, the release roller 88 enters the movement path R1, whereas under the condition that the slider 83 is lowered as shown in FIG. 12B, the release roller 88 is retracted downwardly below the movement path R1.

Accordingly, when the wheel body 20 is rotated in a direction indicated by an arrow RW in FIG. 12A after the slider 83 is stopped under the condition that the release roller 88 is raised, the drive lever 52 of the pocket 40 moved up to the top end of the wheel section 6 is brought into contact with the release roller 88 so that the claw 51 of the pocket 40 is opened as indicated by the imaginary line L2 in FIG. 8. Thus, the ball B is dropped away from the pocket 40 which has reached the top end of the wheel section 6.

A pair of roller position detection sensors 90, 90 are mounted on the base plate 81 through a bracket 89. These sensors 90 are composed, for example, of the transmission type optical sensors. A detection plate 91 mounted on the slider 83 is selectively inserted into a slit 90*s* of either one of the sensors 90 in accordance with the ascending or descending motion of the slider 83 to thereby interrupt the detection light beam of the sensor 90 to change the output signal of the sensor 90. Thus, it is possible to judge whether the release roller 88 is moved up to the upper terminal or down to the lower terminal.

Figure 15:
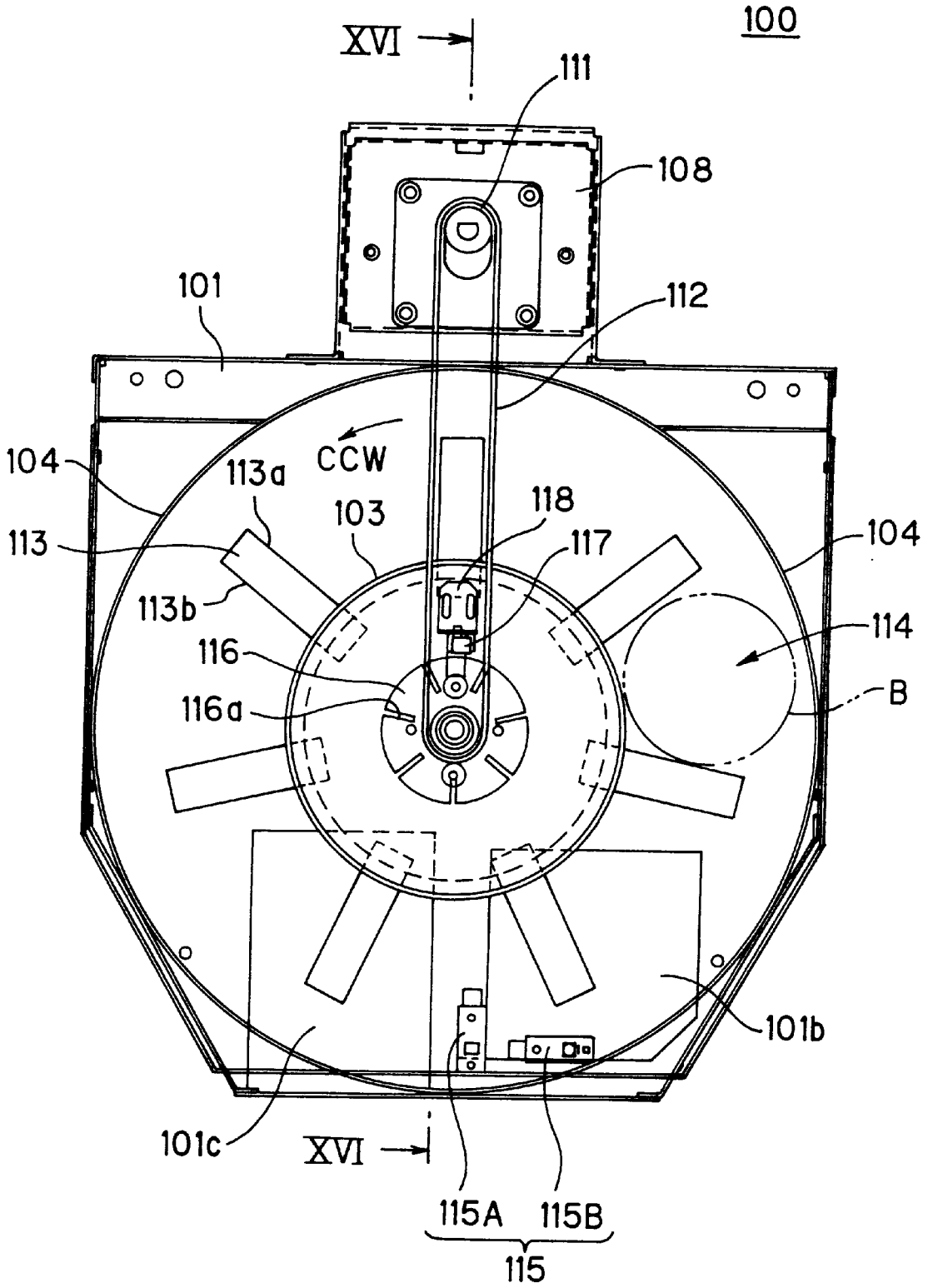
FIG. 15 is a view showing an internal structure of a supplier unit serving as a throwing device and a receiving device.
Figure 16:
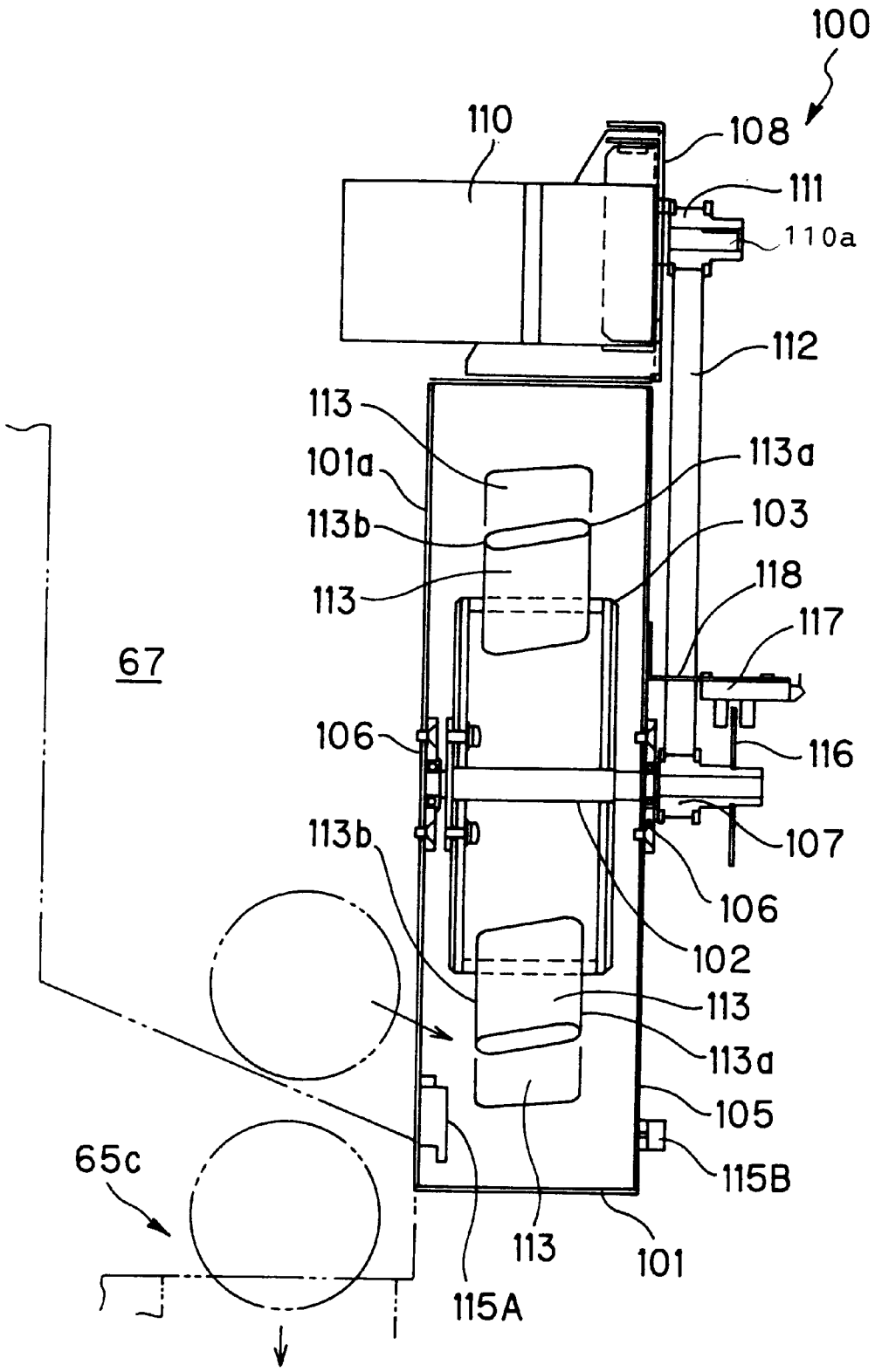
FIG. 16 is a cross-sectional view taken along the line XVI—XVI of FIG. 15.
Figure 17:
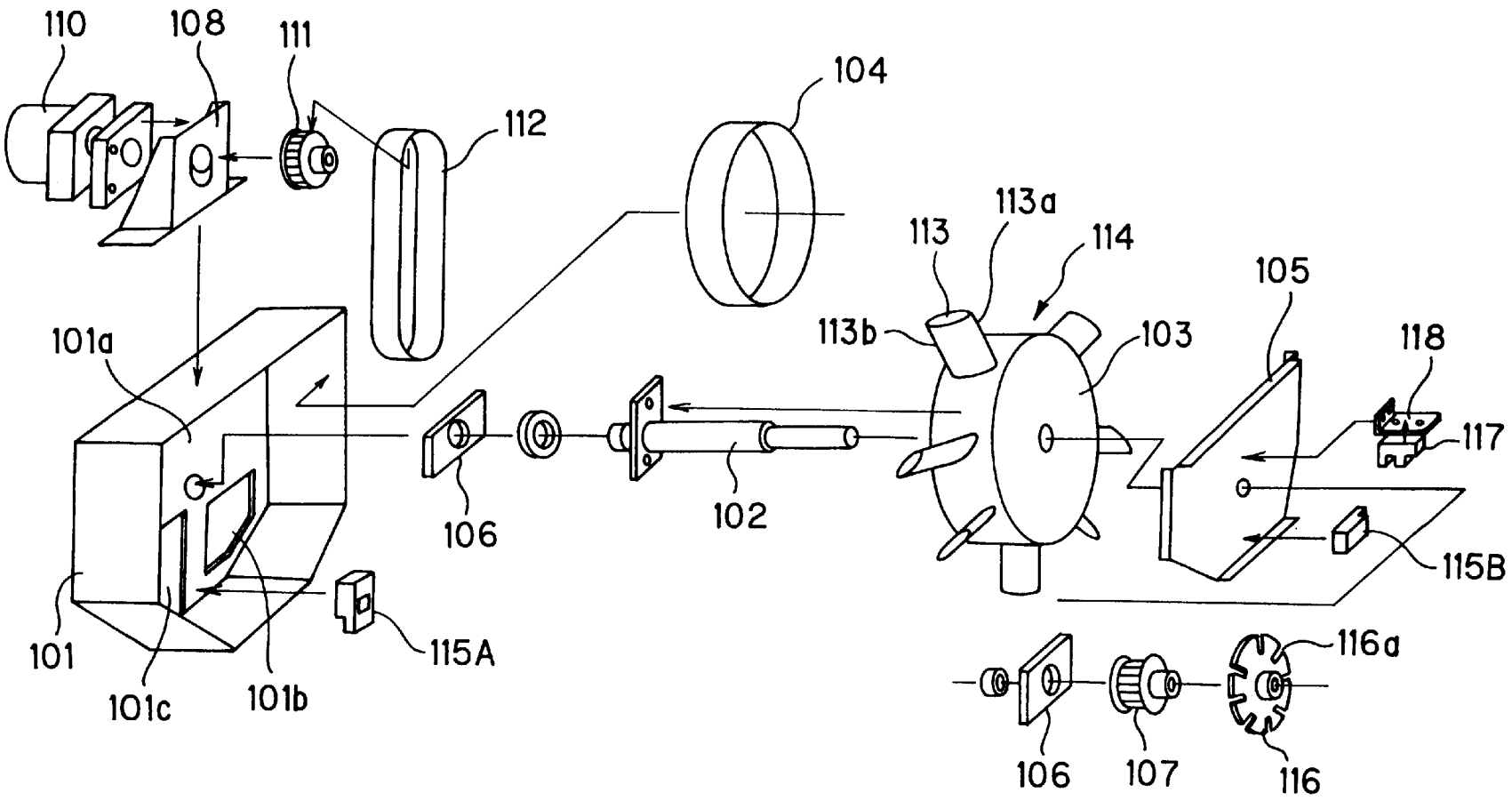
FIG. 17 is an exploded perspective view showing the supplier unit.
Figure 18:
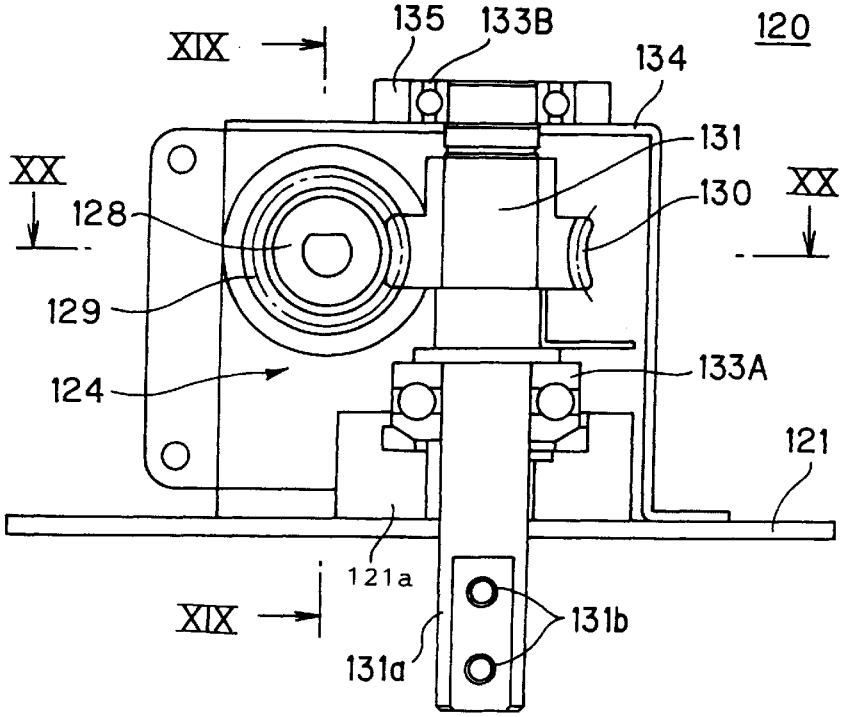
FIG. 18 is a vertical sectional view showing an object drive unit.
Figure 19:
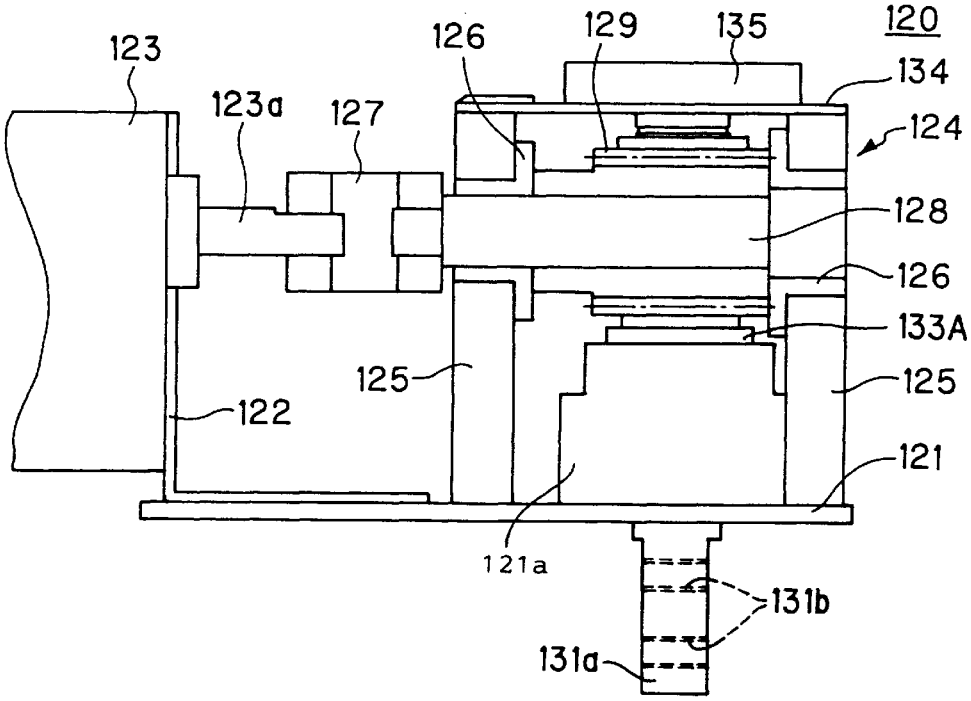
FIG. 19 is a cross-sectional view taken along the line XIV—XIV of FIG. 18.
Figure 20:
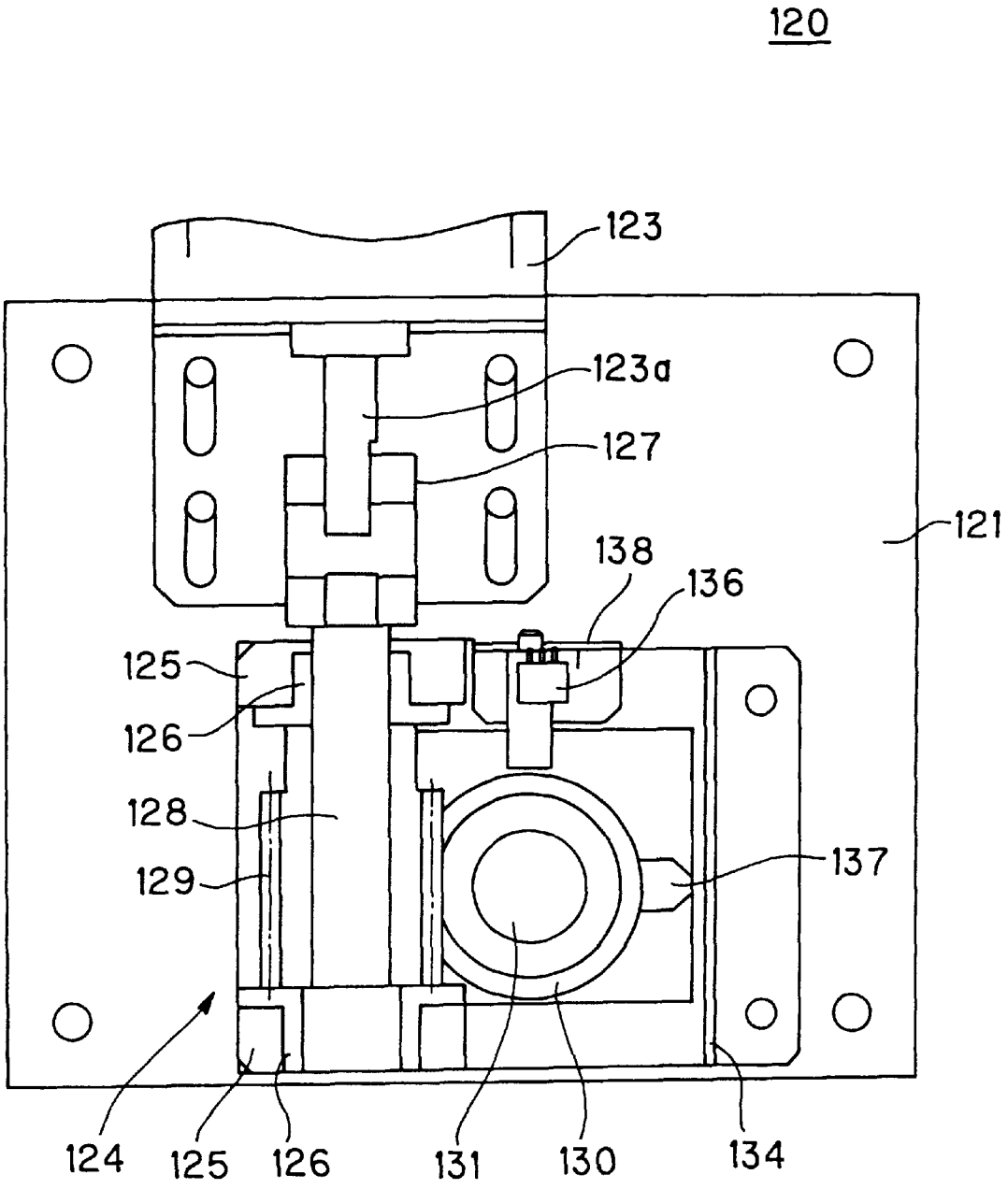
FIG. 20 is a cross-sectional view taken along the line XX—XX of FIG. 18.
Figures 21A, 21B, 21C:
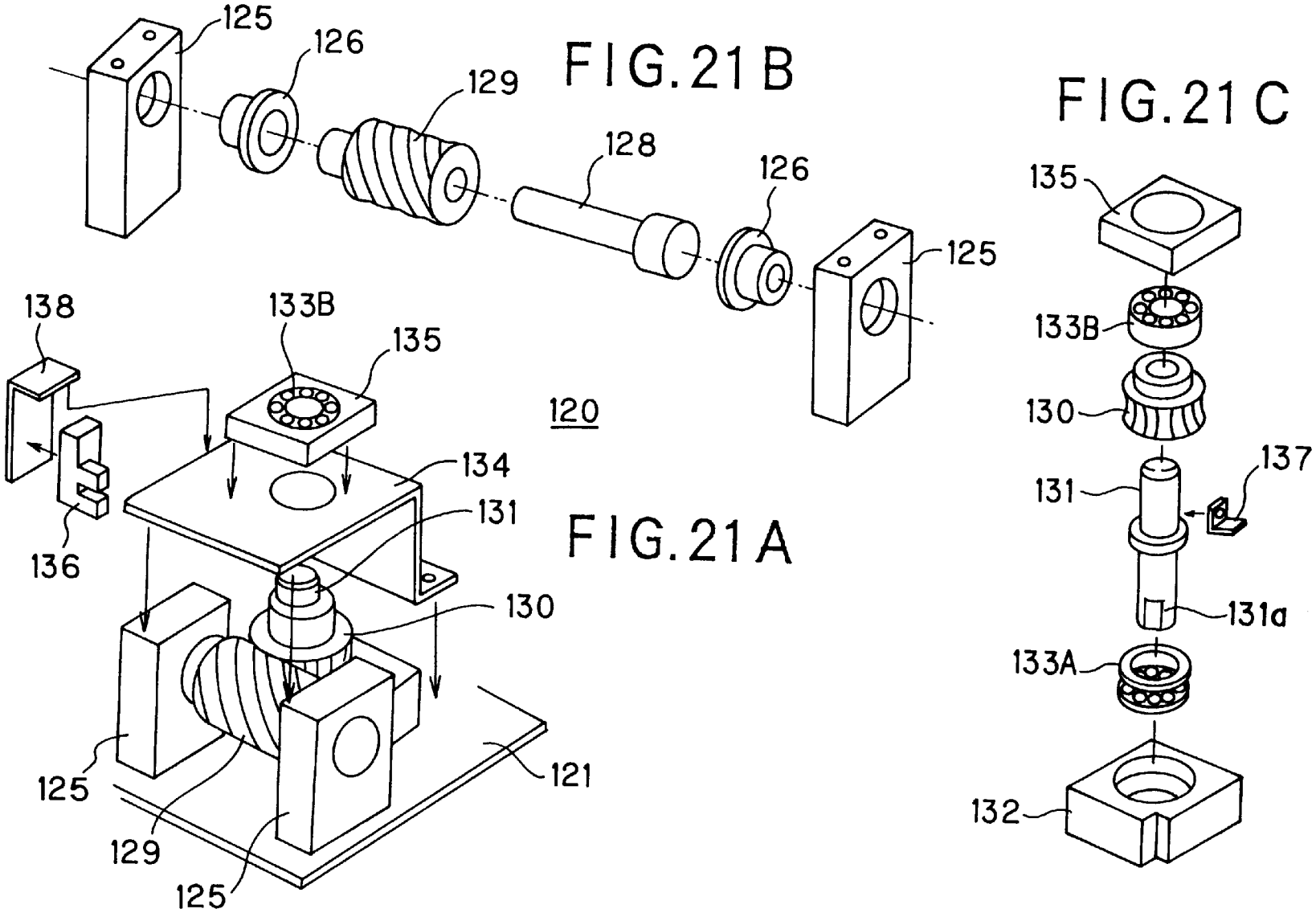
FIGS. 21A to 21C are exploded perspective views of the object drive unit, FIG. 21A being a perspective view showing the overall unit, FIG. 21B being an exploded perspective view showing a worm shaft side, and FIG. 21C being an exploded perspective showing a worm wheel side.

As shown in FIGS. 15 to 17, the supplier unit 100 has a box 101 fixed to the side wall 65*a* (see FIG. 2) of the unit mounting base plate 65, a collection wheel 103 serving as a rotary member rotatably mounted in the box 101 through a drive shaft 102, a guide sleeve 104 surrounding an outer circumference of the collection wheel 103, and a lid 105 closing the box 101. The drive shaft 102 is disposed perpendicular to a rotation surface of the wheel section 6. Both end portions of the drive shaft 102 are rotatably supported to the box 101 and the lid 105 through bearing units 106, 106.

A tip end portion of the drive shaft 102 is projected from the lid 105 and a pulley 107 is mounted on its projected portion so as to be rotatable together with the drive shaft 102. A supplier motor 110 is mounted on a top surface of the box 101 through a bracket 108 and a belt 112 is stretched between a pulley 111 mounted on an output shaft 110*a* of the motor 110 and the pulley 107 on the drive shaft 102.

Vanes 113 . . . 113 serving as projecting portions are mounted at a constant pitch (360/7°) in the circumferential direction on an outer circumference of the collection wheel 103. The number of the vanes 113 is set at seven which is greater by one than the number of the balls B to be used in the game. A ball inlet 101*b* and a ball outlet 101*c* are formed in a vertical wall 101*a* provided inside the box 101, respectively. The ball inlet 101*b* is connected to a ball collection path 67 formed in the unit mounting plate 65, while the ball outlet 101*c* is disposed just above a ball dropping port 65*c* formed on a bottom plate 65*b* of the unit mounting base plate 65.

The interval between the inlet 101*b* and the outlet 101*c* substantially corresponds to the pitch of the vanes 113. Namely, the interval between the inlet 101*b* and the outlet 101*c* is set in such a manner that when one of the receiving spaces 114 for the balls B formed between the vanes 113 overlaps with the inlet 101*b*, the other receiving space 114 adjacent thereto overlaps with the outlet 101*c*.

The ball B picked up from the pocket 40 by the release unit 80 is introduced into the ball collection path 67. The introduced ball B moves from the ball inlet 101*b* to the interior for the box 101 and is received in the receiving space 114 between the vanes 113 of the collection wheel 103. By repeatedly rotating the collection wheel 103 by the pitch of the vanes 113 through the supplier motor 110, the vacant receiving spaces 114 are fed one after another before the ball inlet 101*b* so that the six balls in total may be received in order.

When the ball B is received from the ball inlet 101*b*, the detection light beam which is emitted from a light emitting portion 115A of a ball collection sensor 115 using a transmission type optical sensor toward a light receiving portion 115B is interrupted so that an output signal from the light receiving portion 115B is changed. The absence/presence of the receipt of the ball B may be judged on the basis of the output signal.

In order to rotate the collection wheel 103 by the pitch of the vanes 113, a slit disc 116 provided with seven slits 116*a* is mounted on the drive shaft 101 so as to be rotatable together with the drive shaft 101, and a collection wheel indexing sensor 117 using a transmission type optical sensor for detecting the slit 116*a* of the slit disc 116 is mounted on the lid 105 through a bracket 118.

The vanes 113 are slanted obliquely relative to the axial direction of the drive shaft 102. The slant direction thereof is set in such a manner that each vane 113 is shifted counterclockwise of FIG. 15 as it goes from the side of the lid 105 toward the inside of the box 101 (on the side of the provision of the vertical wall 101*a*) along the axial direction of the drive shaft 102. In other words, the rear end 113*b* of each vane 113 is displaced counterclockwise from the front end 113*a* thereof as viewed from the side of the lid 105.

Accordingly, in the case where the collection wheel 103 is rotated counterclockwise (in the direction of the arrow CCW) in FIG. 15, the ball B received from the ball inlet 101*b* is pushed toward the lid 105 in accordance with the slant of the vanes 113 and simultaneously moves upward about the drive shaft 102. After the ball B has been passed through the upper end of the guide sleeve 104, the ball B is lowered about the drive shaft 102 while rolling toward the vertical wall 101*a* of the box along the slant of each vane 113. The ball B which has reached the ball outlet 101*c* is discharged outside of the box 101 so that it rolls down from the vane 113 and is thrown from the ball dropping port 65*c* to the ball guide section 7. Thus, the collection wheel 103 for receiving the balls B can be functioned as the throwing device of the balls. Incidentally, since the number of the receiving spaces 114 is greater by one than the number of the balls, there is no possibility that the ball B would be dropped from the outlet 101*c* during the receipt of the balls.

As shown in FIGS. 18 to 21, the object drive unit 120 has a base 121 fixed to the unit mounting base plate 65, an object drive motor 123 fixed to the base 121 through a bracket 122 and a speed reduction mechanism 124 for reducing a rotational speed of an output shaft 123*a* of the motor 123.

The speed reduction mechanism 124 is provided with an intermediate drive shaft 128 which is supported horizontally through bushes 126, 126 between a pair of brackets 125, 125 fixed to the base 121 and which is coupled at one end thereof with the motor output shaft 123*a* through a coupling 127, a worm shaft 129 mounted on the outer circumference of the intermediate drive shaft 128 so as to be rotatable therewith, a worm wheel 130 meshed with the worm shaft 129, and an object drive shaft 131 inserted into a central portion of the worm wheel 130 so as to be rotatable therewith. The object drive shaft 131 is supported through a thrust bearing 133A to a housing 130 mounted on the base 121 and can be rotated about the axis in the vertical direction. The upper end portion of the object drive shaft 131 is fitted to a radial bearing 133B which is mounted through a housing 135 on a top surface of a bracket 134 fixed to the base 121. A lower end portion of the object drive shaft 131 is projected downwardly through the base 121. An object attaching portion 131*a* provided with male screw portions 131*b*, 131*b* is formed in the projected portion of the object drive shaft 131.

An object rotary sensor 136 using a transmission type optical sensor is mounted on the bracket 134 through a holder 138. A detection plate 137 is mounted at one position on the circumference of the object drive shaft 131. Every time the object drive shaft 131 makes one turn, the detection plate 137 is once passed through the slit 136*a* of the sensor 136. Thus, the output of the sensor 136 is changed to thereby detect the rotation of the object drive shaft 131.

As shown in FIGS. 1 and 2, the ball guide section 7 has a transparent and spherical dome cover 140 (see FIG. 1) mounted on the inner circumference of the wheel body 20 and an object 141 provided within the dome cover 140. The dome cover 140 is fixed to the bottom plate 65*b* of the unit mounting base plate 65 and lower ends thereof overlaps with the inner circumferential portions of the covers 37 at a predetermined interval (see FIG. 4). The dome cover 140 prevents the balls B from jumping out, causes the balls B to positively drop toward the pockets 40 and also prevents the manual operation to the balls B dropping down.

Figure 22:
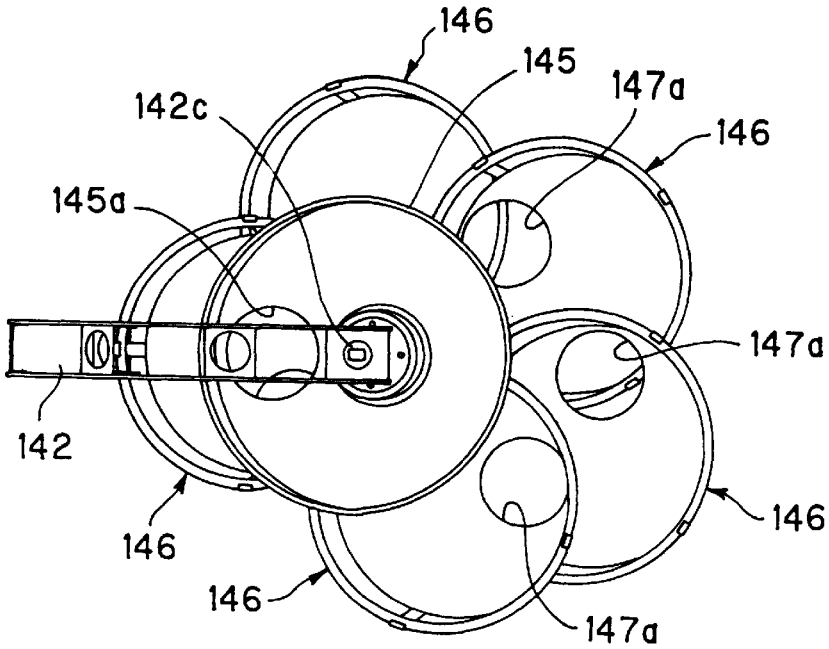
FIG. 22 is a plan view showing an object to be driven by the object drive unit.
Figure 23:
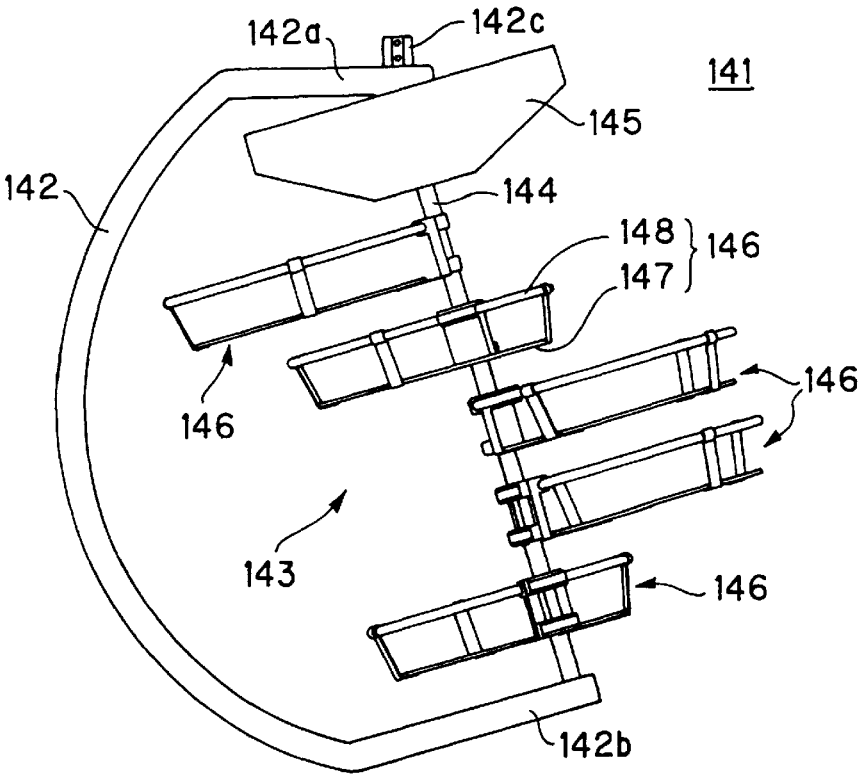
FIG. 23 is a front view of the object.
Figure 24:
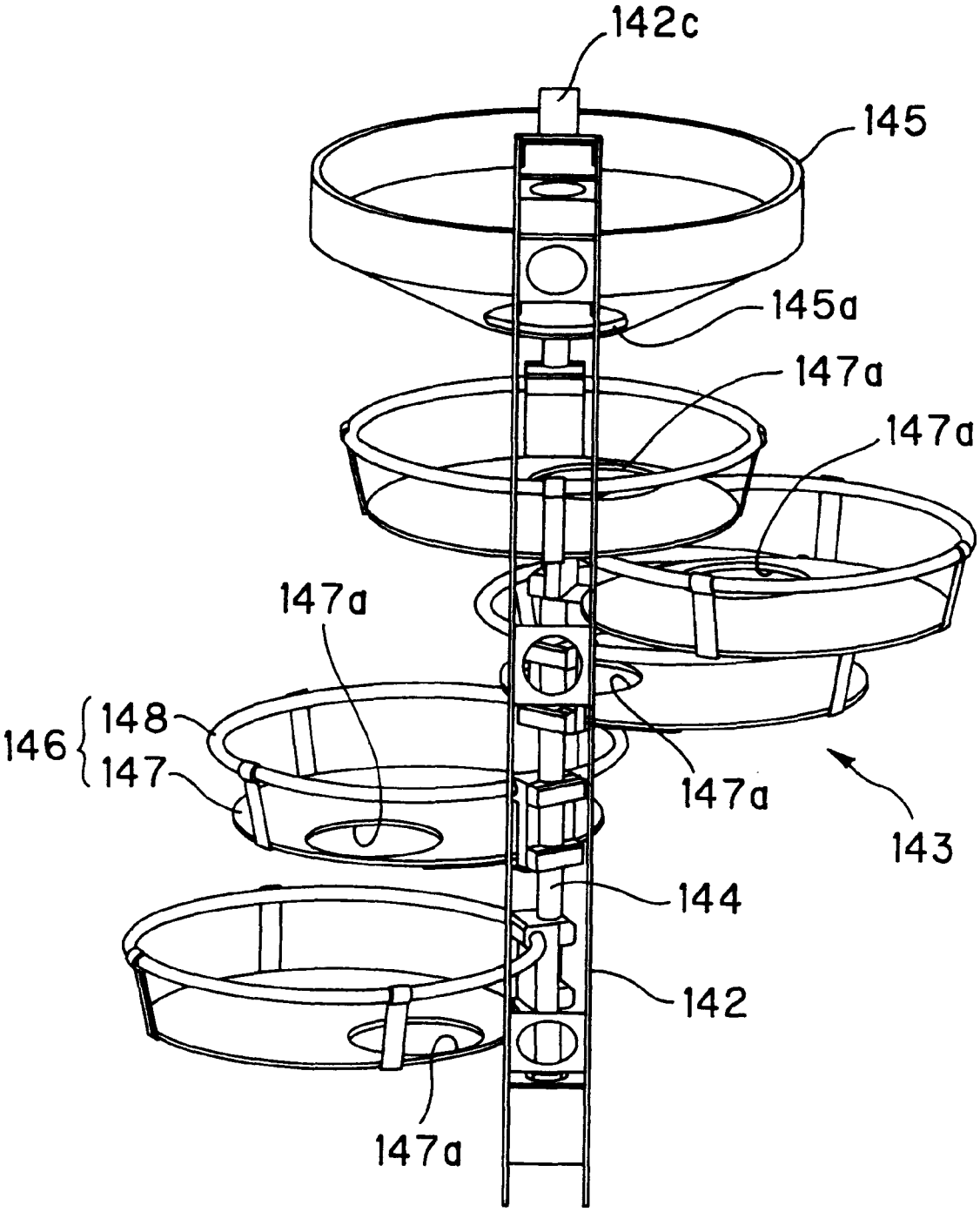
FIG. 24 is a rear view of the object.

As shown in FIGS. 22 to 24, the object 141 is used to irregularly change a drop time of the ball B from the ball drop port 65*c* to the pocket 40. The object 141 has an arcuately curved main frame 142 and a swivel unit 143 mounted within the main frame 142. The swivel unit 143 has a swivel shaft 144 bridging between upper and lower ends 142*a* and 142*b* of the main frame 142, a hopper 145 mounted coaxially at the upper end of the swivel shaft 144, and a plurality (five in FIG. 23) of stages 146 . . . 146 connected to the swivel shaft 144 below the hopper 145.

A joint device such as a socket 142*c* for the object drive unit 120 is provided at the upper end 142*a* of the main frame 142. The socket 142*c* is fitted around the outer circumference of an object attaching portion 131*a* of the object drive shaft 131, and bolts (not shown) are screwed into female screw portions 131*b* of the object attaching portion 131 from the outside thereof (see FIGS. 18 and 19) so that the object 141 is suspended from the object drive shaft 131.

The swivel shaft 144 is supported to the main frame 142 under the condition that its axis is slanted relative to the axial direction of the socket 142*c* (the vertical direction in FIG. 23) and can be rotated about its slanted axis. The hopper 145 serves to receive and lead the ball B, which is thrown through the drop port 65*c* from the supplier unit 100, to the upper portion of the stages 146 and is formed into a funnel shape as a whole with an opening 145*a* through which the ball B passes being formed in its bottom portion.

Each stage 146 has a disc-like bottom plate 147 and a holder frame 148 surrounding its outer circumference. An opening 147*a* is formed in each bottom plate 147 for the passage of the ball B therethrough. The uppermost stage 146 is provided in such a manner that the bottom plate 147 thereof overlaps with the opening 145*a* of the hopper 145 in the vertical direction and the openings 145*a* and 147*a* are displaced relative to each other in the circumferential direction. Each opening 147*a* of the second and the following stages 146 . . . 146 are also overlapped with the bottom plate 147 of the adjacent lower stage 146 and the stages 146 are coupled with the swivel shaft 144 so that the respective openings 147*a* are not overlapped with each other in the vertical direction.

In the above-described object 141, the ball B will drop as follows. First of all, the ball B thrown from the supplier 100 to the hopper 145 drops down to the bottom plate 147 of the uppermost stage 146 through the opening 145*a* of the hopper 145 to take a rolling motion on the bottom plate 147. A position of a center of gravity of the swivel unit 143 is changed in accordance with the rolling motion and the drop of the ball B, so that the swivel unit 143 is swiveled about the axis of the swivel shaft 144 so as to take a balance with the change. Due to the synergetic effect of the swivel motion and the rolling motion of the ball B, the ball B takes an irregular motion on the bottom plate 147. As a result, the time period during which the ball B has dropped from the opening 147*a* after the ball has been received on the bottom plate 147 is changed in an irregular manner. This irregular motion is repeated on each stage 145 so that the time period during which the ball B is received in the pocket 40 from the throw of the ball B from the supplier unit 100 is changed. As a result, it is possible for the player to more enjoy to predict which pocket 40 receives the ball B.

When the main frame 142 is rotated about the axis of the main frame 142 in the vertical direction by driving the object drive shaft 131 by the object drive unit 120, a rotational torque is transmitted also to the swivel unit 143 rotatably supported to the main frame 142 to some extent to thereby break the balance about the swivel shaft 144. By imparting this operation thereto, the ball B takes a further complicated motion to make it possible to variously change the time period taken for the drop of the ball B.

Figure 25:
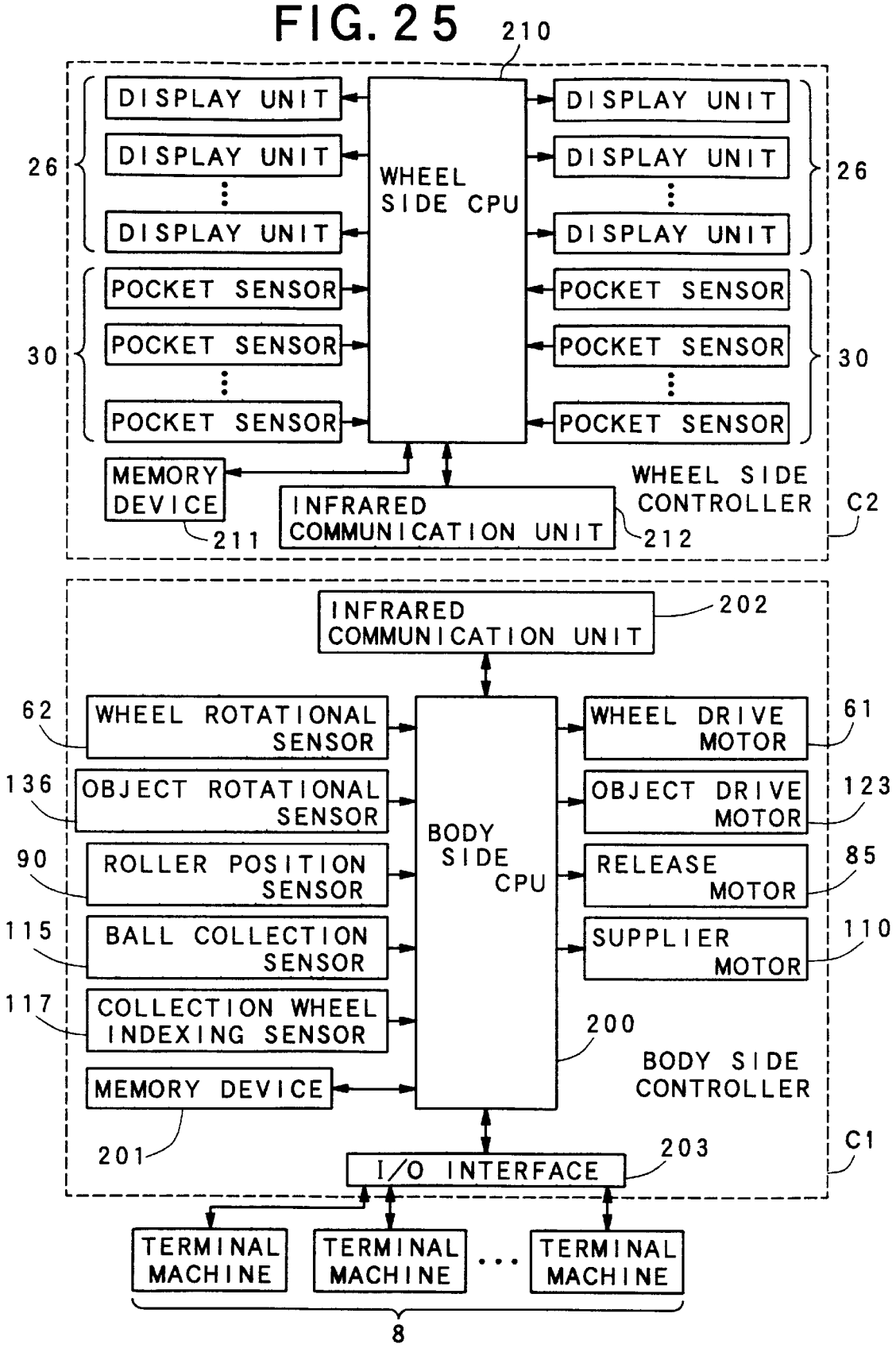
FIG. 25 is a block diagram showing a structure of a control system for the game machine of FIG. 1.

FIG. 25 is a block diagram showing a structure of a control system for the present game machine 1. As is apparent from FIG. 25, the control system for the game machine 1 has a body controlling section C1 and a wheel controlling section C2.

The body side CPU 200 mainly composed of a microprocessor is provided in the body controlling section C1. The CPU 200 performs a variety of calculations and operation controls required to progress the game in accordance with data and programs stored in a memory device 201. For instance, connected to the CPU 200 are the wheel rotation sensor 62, the roller position detection sensors 90, the ball collection sensor 115, the collection wheel indexing sensor 117 and the object rotation sensor 136. The CPU 200 controls the respective operations of the wheel drive motor 61, the release motor 85, the supplier motor 110 and the object drive motor 123 in accordance with the output signals from these sensors. The memory device 201 is composed, for example, of semiconductor memory elements such as RAMs, ROMs or the like. Furthermore, the CPU 200 performs the communication with the wheel controlling section C2 through the infrared ray head 202*a* of the infrared ray communication unit 202 (see FIGS. 3 and 5), and at the same time performs the communication with the terminal machines 8 through an input/output interface 203. Incidentally, an intrinsic controlling device including a CPU is mounted also on each terminal machine 8, however the explanation of its detail will be omitted.

The wheel side CPU 210 which is mainly composed of a microprocessor is provided in the wheel controlling section C2. As described above, the wheel side CPU 210 is mounted on one of the ten blocks of the control substrates 25 provided on the wheel section 6 and performs the control of the communication with the body controlling section C1 or the like by using the infrared ray unit 212 and the control of the display to the display units 26 in accordance with data and programs stored in a memory device 211 which is composed of semiconductor memory elements such as RAMs, ROMs or the like.

Figure 26:
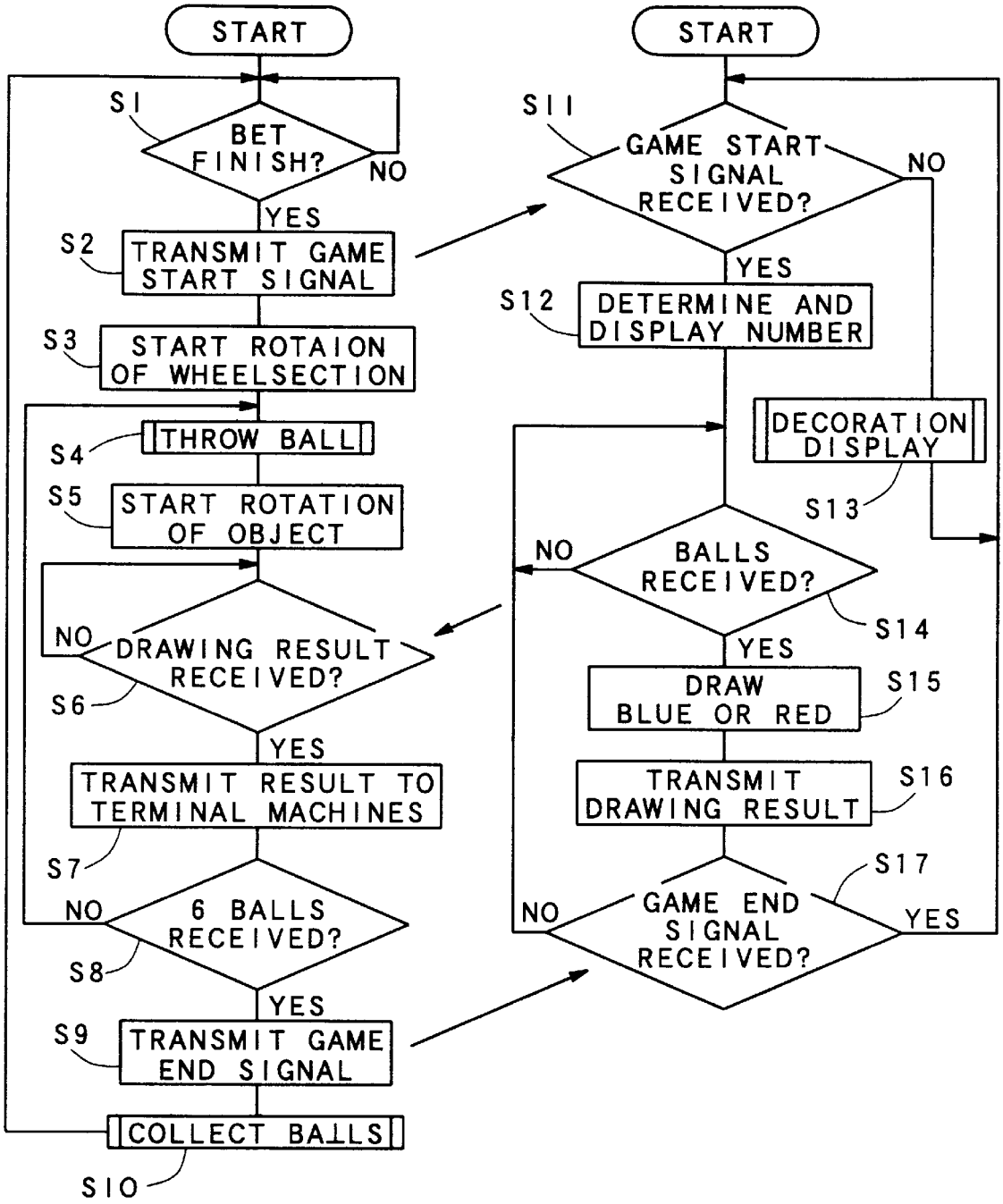
FIG. 26 is a flowchart showing the procedure of the game to be executed by the control system.

FIG. 26 is a flowchart showing a processing procedure of the game to be performed in the game machine 1. The left side and the right side of FIG. 26 show a process to be executed by the body side CPU 200 and a process to be executed by the wheel side CPU 210, respectively. When a predetermined starting operation (operation of turning the power source switch or the starting switch on) is effected to the game machine 1, the CPUs 200 and 210 perform predetermined start processes and thereafter the processes shown in FIG. 26.

First of all, the body side CPU 200 judges whether or not the bets through the respective terminal machines 8 have been completed (step S1) and outputs a predetermined game start signal to the wheel side CPU 210 after the completion of the bets (step S2). The completion of the bets is determined by providing, for example, a constant limit time from the game start, and by judging whether or not the limit time has lapsed. Also, it is possible to determine it by judging whether or not a terminal signal is outputted in response to the bet completion operation of the player from each terminal machines 8.

Figure 27:
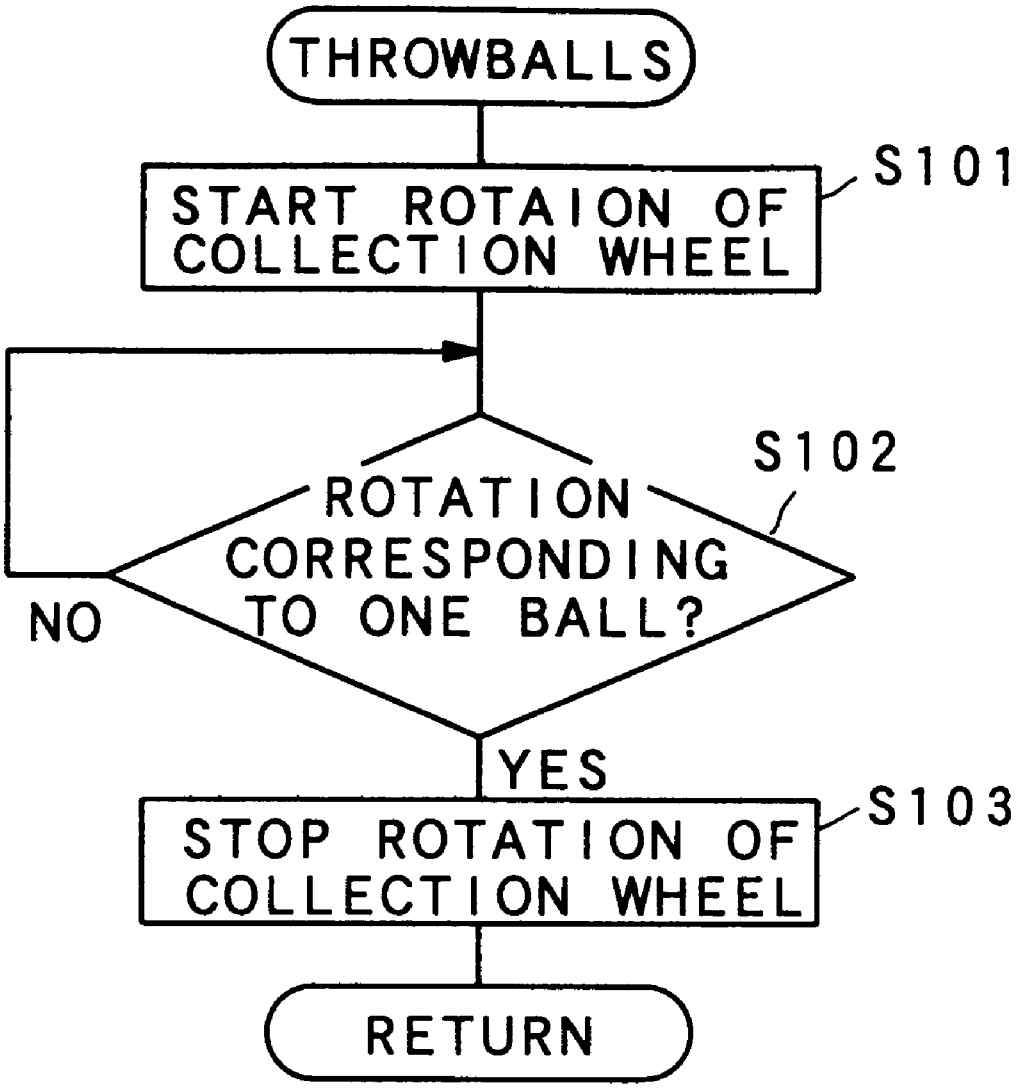
FIG. 27 is a flowchart showing the procedure of a subroutine for throwing the balls to be executed in the process shown in FIG. 26.

Next, the wheel drive motor 61 is started to thereby rotate the wheel section 6 (step S3). Thereafter, a subroutine process is performed for throwing the ball B from the supplier unit 100 to the guide section 7 (step S4). As shown in FIG. 27, in this subroutine process, first of all, the supplier motor 110 is started to rotate the collection wheel 103 counterclockwise (in the direction indicated by the arrow CCW) in FIG. 15 (step S101), next the CPU 200 judges whether or not the collection wheel 103 has been rotated by an angle corresponding to one ball (corresponding to the pitch of the vanes 113) on the basis of the signal from the collection wheel indexing sensor 115 (step S102), and then the motor 110 is stopped if it is judged that the wheel 103 has been rotated. As described above, since the vanes 113 are provided obliquely relative to the axis of the axis of its rotation, this process causes the single ball B to be certainly thrown from the supplier unit 100 to the ball guide 7.

When the ball B has been thrown, the object drive motor 123 is started to rotate and drive the object 141 to rotate the main frame 142 of the object 141. As a result, the ball B which has been thrown into the ball guide section 7 is passed through the respective stages 146 one after another and dropped toward the lower end of the wheel section 6. After the object 141 has been rotated, the CPU 200 judges whether or not a signal representative of a predetermined drawing result is received from the wheel side CPU 210 (step S6). If not, the CPU 200 waits for the receipt of the signal.

On the other hand, the wheel side CPU 210 judges whether or not, first of all, the game start signal is received from the body side CPU 200 after the completion of the start operation (step S11). If this signal is not received, a process for performing a predetermined demonstration display is performed by using the display units 26 (step S12). This demonstration display is to display, for example, a variety of figures, signs or the like on the display units 26 or to change flash of these figures or the like the display colors to thereby enhance an eye catch effect (effect to attract the vision of the player) of the game machine 1.

When the CPU 210 has received the game start signal, any one of the integers 1 to 25 is applied at random to each pocket 40 of the wheel section 6, and the allotted number is displayed on the associated display unit 26 (step S13).

Subsequently, the CPU 210 judges whether or not the ball B is received in any one of the pocket 40 on the basis of the signal from the pocket sensor 30 (step S14). When the ball B is received, the CPU 210 performs the drawing for allotting blue or red to the pocket 40 receiving the ball B. According to the drawing result, the display color of the display unit 26 corresponding to the pocket 40 which receives the ball B is set in blue or red (step S15). Subsequently, the CPU 210 transmits the lucky number (the number assigned to the pocket 40 receiving the ball B) and the distinction of the lucky number between blue and red to the body side CPU 200 as a result of the drawing (step S16). Thereafter, the CPU 210 judges whether or not the predetermined game completion signal has received from the body side CPU 200 (step S17). If not, the operation goes to the step S14, and if it is, the operation returns back to the step S11, respectively.

When the wheel side CPU 210 has transmitted the drawing result, the body side CPU 200 judges affirmatively at the step S6 and transmits the received drawing result to each of the terminal machines 8 (step S7). The game is advanced for every terminal machine 8 in accordance with the drawing result. The drawing result is typically used for the bingo game. However, there is the distinction between the red and blue to the lucky number, this is not a simple number identification game but can realize a variety of games by adding a variety of factors such as paying a bonus when the color which is betted by the player accords with the color of the lucky number.

After the drawing result has been transmitted, the CPU 200 judges whether or not all six balls B are thrown (step S8). If not, the operation returns back to the step S4. If all six balls have been thrown, the game completion signal is outputted to the wheel side CPU 210 (step S9). Subsequently, the subroutine process for collection the balls B from the pockets 40 to the supplier unit 100 is performed (step S10). Thereafter, the operation returns to the step S1.

Figure 28:
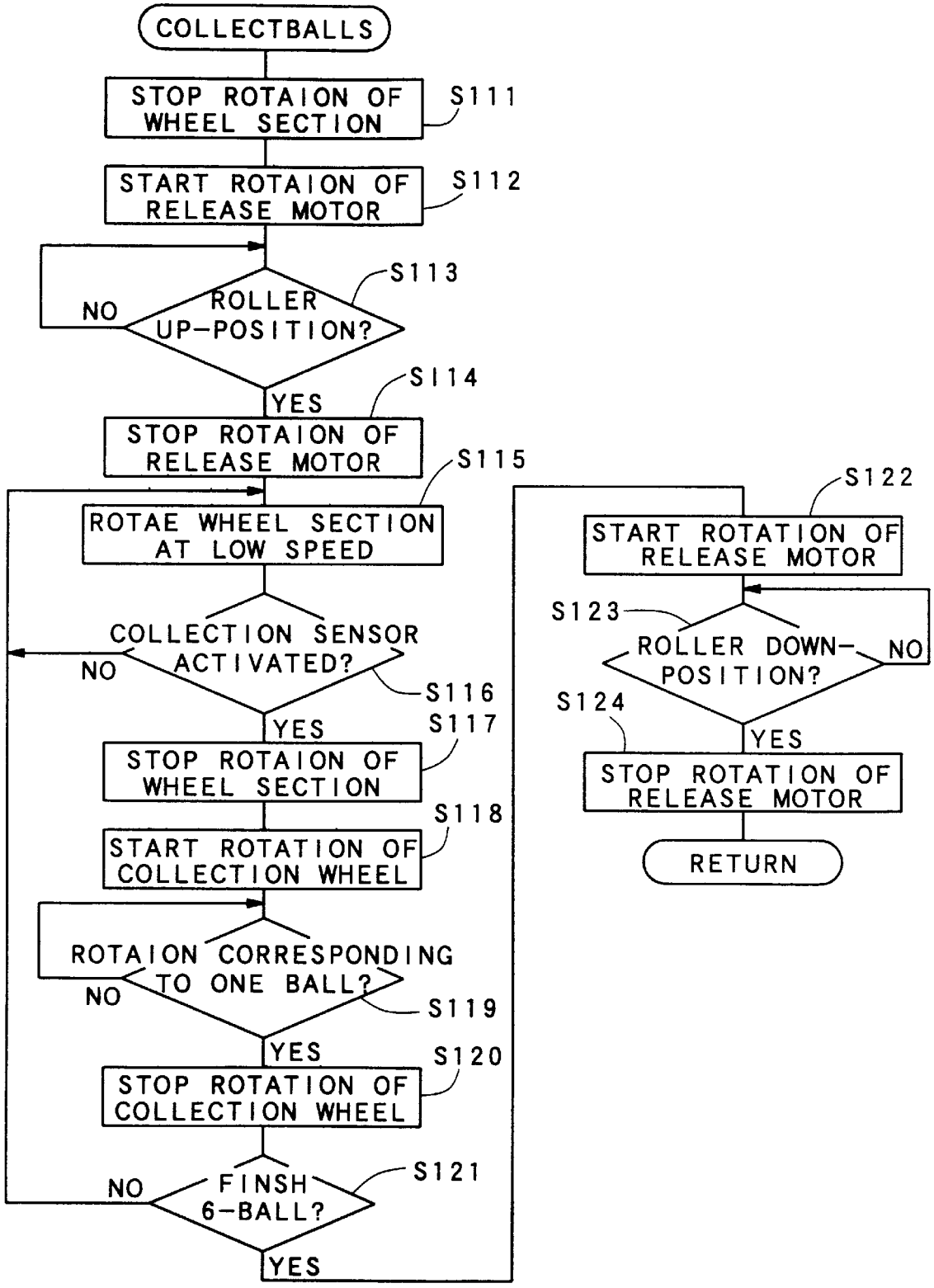
FIG. 28 is a flowchart showing the procedure of a subroutine for collecting the balls to be executed in the process shown in FIG. 26.

As shown in FIG. 28, when in the ball collection process, first of all, the CPU 200 stops the rotation of the wheel drive motor 61 (step S111), and drives the release motor 85 of the release unit 80 to move the release roller 88 upwardly (step S112). Thereafter, the CPU 200 judges whether or not the roller 88 has reached the upper end in its movable range on the basis of the output signal from the roller position sensor 90 (step S113). When the roller 88 has reached the upper end, the release motor 85 is stopped (step S114).

Subsequently, the wheel drive motor 61 is started to thereby rotate the wheel section 6 at a low speed (step S115). At this time, the rotational speed is set at a speed slower than the rotational speed as in the step S3 or the like. The rotational direction is adjusted in such a manner that the pocket 40 moves in the direction indicated by the arrow RW of FIG. 12A. At this time, since the release roller 88 is located at the upper end position (position shown in FIG.

12A), the release roller 88 and the drive lever 52 of the pocket 40 are brought into contact with each other whenever the pocket 40 passes through the upper end portion of the wheel section 6 so that the claw 51 of each pocket 40 is opened. As a result, the ball B received in each pocket 40 is dropped from the pocket 40 to the supplier unit 100 at the moment the ball B has reached the upper end of the wheel section 6.

After the start of the rotation of the wheel section 6, the CPU 200 judges whether or not a reaction representing the collection of the ball B in the ball collection sensor 115 of the supplier unit 100 is presented (step S116). If there is no reaction, the operation returns to the step S115, and if there is the reaction, the rotation of wheel section 6 is stopped. Subsequently, the supplier motor 110 of the supplier unit 100 is started to rotate the collection wheel 103 in the counter-clockwise direction (direction indicated by the arrow CCW) in FIG. 15 (step S118) and the CPU 200 judges whether or not the collection wheel 103 has been rotated by the angle corresponding to the single ball (corresponding to the pitch of the vanes 113) on the basis of the signal from the collection wheel indexing sensor 115 (step S119). Due to this rotation, the ball B is rotated with being certainly received in the supplier unit 100 and the vacant space 114 is fed to the position facing the ball inlet 101*b*.

The rotation of the collection wheel 103 is stopped after it has been rotated by an angle corresponding to one of the ball B (step S120). Thereafter, the CPU 200 judges whether or not the collection of all six balls B is performed (step S121). The number of the collected balls is distinguished by counting the number of the affirmative judgement at the step S119 after the start of the process in FIG. 26, for example.

When all six balls B have been collected, the release motor 85 of the release unit 80 is driven to move the release roller 88 downwardly (step S122). Thereafter, the CPU 200 judges whether or not the roller 88 has reached the lower end in its movable range on the basis of the output signal from the roller position sensor 90 (step S123). When the roller 88 has reached the lower end, the release motor 85 is stopped (step S 124). Thus, the process for collecting the balls B have been completed.

The present invention is not limited to the application of the above-described embodiment and may be applied to other modifications. For example, the number of the balls is not limited to six. The wheel section 6 is not limited to that swiveling along the vertical plane and may be that swiveling along a path slanted to the horizontal plane. Namely, if the difference in height in the swivel path of the wheel device is provided, it is possible to apply the present invention thereto equally. The rotary member as the device for receiving the balls in the collection device is also used as the throwing device, however it is possible to provide both devices independently. The projections of the rotary member are not limited to that radially projected from the outer circumferential portion and may be projected in the tangential direction of the rotary member.

As described above, according to the present invention, since the collection device and the receiving device of the balls are provided on the upper end side of the swivel path of the wheel device, it is not necessary to rise the balls along the outer circumference of the wheel device when the received balls are thrown to the lower end side of the wheel device. As a result, it is possible to simplify the structure of the throwing device. Accordingly, it is possible to reduce the number of the parts that constitute the game machine, the work of maintenance thereof or the manufacture thereof and the cost therefor.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A ball game machine comprising:

a wheel device which has a plurality of ball holding portions along an inner circumference thereof and which is rotatably provided along a predetermined swivel path having a difference in height;

a receiving device disposed on a side of an upper end of the swivel path of said wheel device for receiving a predetermined number of balls;

a throwing device for throwing the balls received in said receiving device downwardly from the side of the upper end of the swivel path;

a guide device for leading the balls thrown by said throwing device to the ball holding portions of said wheel device fed on the side of the lower end of the swivel path; and a collection device disposed on the side of the upper end of the swivel path of said wheel device for collecting the balls, which are held in the ball holding portions, to said receiving device.

2. The ball game machine according to claim 1, wherein said receiving device includes a rotary member provided with a plurality of projections at a predetermined pitch along a circumferential direction on an outer circumference thereof so that the balls can be received between the adjacent projections.

3. The ball game machine according to claim 2, wherein said projections are formed into vane-shapes slanted obliquely to an axial direction of said rotary member.

4. The ball game machine according to claim 3, wherein the number of the plurality of projections is greater by one than the number of the balls to be used in a game, and an inlet and an outlet for the balls are formed to be displaced in a rotational direction of said rotary member by a level corresponding to the pitch of said plurality of projections in said receiving device.

5. The ball game machine according to claim 1, wherein each of the ball holding portions is provided with a pair of opening-and-closing members capable of being switched between an opening condition where an inlet-and-outlet opening of each of the ball holding portions is largely opened beyond a diameter of the balls and a restricted condition where the inlet-and-outlet port is more narrowly closed than the diameter of the balls and an operating member driving at least one of the opening-and-closing members for switching the inlet-and-outlet opening from the restricting condition to the opening condition, and wherein said collection device is provided with a release member which is movable between an operating position entering a movement path of said operating member in accordance with a swivel motion of said wheel device and a waiting position which is below the operating position and where the release member is retracted out of the movement path.

6. The ball game machine according to claim 5, further comprising a buffering device for imparting resistance to a returning operation of said at least one of the opening-and-closing members when moving from the opening condition to the restricting condition.

7. The ball game machine according to claim 1, wherein said wheel device is provided so as to be rotatable in the swivel path parallel extending in a vertical plane.

8. The ball game machine according to claim 7, wherein a single portion is used commonly for the inlet-and-outlet opening of the ball holding portion.

9. A ball game machine according to claim 2, wherein the receiving device comprises a box in which the rotary member is housed.

10. A ball game machine according to claim 4, wherein the receiving device comprises a box in which the rotary member is housed and the inlet and the outlet for the balls are formed on the box.

11. A ball game machine according to claim 4, wherein each of the projections is slanted downward with approaching the outlet for the balls when in a position opposite to said outlet to thereby allow the receiving device to serve as the throwing device.

12. A ball game machine according to claim 5, wherein said ball holding portion is provided with a pair of side walls which are opposite to each other in a rotational direction of the wheel device to define a receiving space of one of the balls, one of the side walls is provided with a movable member pivotally connected thereto through a hinge so as to be pivotable about a pivot shaft parallel to a rotational axis of the wheel device, said opening-and-closing members are attached to inner end portions of both of another one of the side walls and the movable member respectively, the movable member is biased by a biasing device to locate the opening-and-closing members in the restricted condition, and the operating member is attached to the movable plate with projecting an inner end thereof from the inner end portions of the side walls so as to be capable of being engaged with the release member in the operating position to thereby operate the movable member against the biasing device to switch the pair of the opening-and-closing members to the opening condition.

13. A ball game machine according to claim 7, wherein the collection device, the receiving device and the throwing device are substantially disposed at the top end of the swivel path.

14. A ball game machine according to claim 13, wherein the receiving device is disposed below the top end portion of the swivel path.

15. A ball game machine according to claim 1, wherein the guide device is provided with an irregular motion generating device for irregularly moving the balls in a direction intersecting a vertical direction to thereby change a time period during which each of the balls reaches a lower end of the swivel path after being thrown by the throwing device.

16. A ball game machine according to claim 15, wherein the irregular motion generating device is provided with a swivel shaft capable of swiveling about an axis thereof slanting relative to the vertical direction and a plurality of stages attached to the swivel shaft so as to be rotatable therewith, each of the stages being provided with a drop obstacle portion to receive the balls with allowing movement in a direction perpendicular to the axis of the swivel shaft and an opening allowing the passage of each ball, and wherein the respective stages are attached to the swivel shaft in such a manner that the opening formed on an upper stage within a pair of the stages which are vertically adjacent each other overlaps in the vertical direction with the drop obstacle portion provided on a lower stage within said pair of the stages and each opening formed on each of said pair of the stages is deviated from each other in a circumferential direction of the stages.

17. A ball game machine according to claim 16, further comprising a support member for supporting upper and lower ends of the swivel shaft so as to be rotatable about the axis thereof and a driving device for rotating the support member about a vertical axis.

18. A ball game machine according to claim 15, wherein the wheel device is rotated around the guide device.

* * * * *